US010557331B2

(12) United States Patent
Rodriguez et al.

(10) Patent No.: US 10,557,331 B2
(45) Date of Patent: Feb. 11, 2020

(54) MULTILATERAL INTELLIGENT COMPLETION WITH STACKABLE ISOLATION

(71) Applicant: Halliburton Energy Services, Inc., Houston, TX (US)

(72) Inventors: Franklin Charles Rodriguez, Addison, TX (US); Wesley P. Dietz, Carrollton, TX (US); Homero D. Maldonado, Dallas, TX (US); Loc Phuc Lang, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 226 days.

(21) Appl. No.: 15/513,151

(22) PCT Filed: Jun. 2, 2016

(86) PCT No.: PCT/US2016/035411
§ 371 (c)(1),
(2) Date: Mar. 21, 2017

(87) PCT Pub. No.: WO2017/209753
PCT Pub. Date: Dec. 7, 2017

(65) Prior Publication Data

US 2018/0187519 A1 Jul. 5, 2018

(51) Int. Cl.
*E21B 41/00* (2006.01)
*E21B 34/06* (2006.01)
(Continued)

(52) U.S. Cl.
CPC ..... *E21B 41/0042* (2013.01); *E21B 34/06* (2013.01); *E21B 47/06* (2013.01);
(Continued)

(58) Field of Classification Search
CPC .... E21B 7/061; E21B 23/002; E21B 41/0042; E21B 41/0035
See application file for complete search history.

(56) References Cited

U.S. PATENT DOCUMENTS 5,564,503 A * 10/1996 Longbottom ..... E21B 7/061 166/117.6
5,730,224 A * 3/1998 Williamson ..... E21B 23/002 166/117.6
(Continued)

FOREIGN PATENT DOCUMENTS

| | | |
|---|---|---|
| AU | 200197511 B2 | 2/2002 |
| GB | 2389600 A | 12/2003 |
| WO | 2013165342 A1 | 11/2013 |

OTHER PUBLICATIONS

International Search Report and Written Opinion for PCT/US2016/035411, dated Feb. 8, 2017.

*Primary Examiner* — Kipp C Wallace
(74) *Attorney, Agent, or Firm* — Scott Richardson; C. Tumey Law Group PLLC

(57) ABSTRACT

A well system including a parent wellbore, a lateral wellbore extending from the parent wellbore, and a reentry window assembly installed within the parent wellbore and including a completion window assembly having a window and providing an upper coupling, a muleshoe, and upper and lower slots provided on opposing axial ends of the window. An isolation sleeve is positioned within the completion window assembly and includes a sleeve alignment key, a sleeve coupling, and an engagement device. A whipstock is matable with the sleeve coupling and an aligning tool is operatively coupled to the whipstock and engageable with the muleshoe to angularly orient a whipstock face to the window. The isolation sleeve is movable between closed and open positions to isolate the lateral wellbore, and the sleeve alignment
(Continued)

key interacts with the upper and lower slots to angularly orient the isolation sleeve while moving between the first and second positions.

23 Claims, 16 Drawing Sheets

(51) Int. Cl.

| | |
|---|---|
| ***E21B 47/06*** | (2012.01) |
| ***E21B 47/10*** | (2012.01) |
| *E21B 7/04* | (2006.01) |
| *E21B 29/06* | (2006.01) |
| *E21B 33/12* | (2006.01) |
| *E21B 43/14* | (2006.01) |

(52) U.S. Cl.
CPC ..... *E21B 47/065* (2013.01); *E21B 47/10* (2013.01); *E21B 7/04* (2013.01); *E21B 29/06* (2013.01); *E21B 33/12* (2013.01); *E21B 43/14* (2013.01)

(56) References Cited

U.S. PATENT DOCUMENTS

| | | | | |
|---|---|---|---|---|
| 5,787,987 | A * | 8/1998 | Forsyth | E21B 7/061 166/117.6 |
| 5,918,669 | A | 7/1999 | Morris et al. | |
| 6,095,248 | A * | 8/2000 | Freeman | E21B 43/305 166/117.6 |
| 6,732,802 | B2 | 5/2004 | Smith | |
| 7,070,000 | B2 | 7/2006 | Smith et al. | |
| 8,376,054 | B2 * | 2/2013 | Lang | E21B 47/024 166/242.6 |
| 2010/0181067 | A1 * | 7/2010 | Chen | E21B 41/0035 166/253.1 |
| 2011/0024121 | A1 | 2/2011 | Skeates et al. | |
| 2011/0253376 | A1 * | 10/2011 | Krpec | E21B 37/00 166/311 |
| 2012/0138301 | A1 | 6/2012 | Assal et al. | |
| 2012/0261130 | A1 | 10/2012 | Linn et al. | |
| 2014/0144617 | A1 | 5/2014 | Telfer et al. | |
| 2015/0369022 | A1 * | 12/2015 | Zhou | E21B 43/12 166/373 |

* cited by examiner

MULTILATERAL INTELLIGENT COMPLETION WITH STACKABLE ISOLATION

BACKGROUND

Multilateral well technology allows an operator to drill a parent wellbore, and subsequently drill one or more lateral wellbores that extend from the parent wellbore at desired angular orientations. For many well completions, such as offshore deepwater wells, multiple lateral wellbores are often drilled from a single parent wellbore in an effort to optimize hydrocarbon production while minimizing overall drilling and well completion costs.

Briefly, drilling a multilateral well first requires that the parent wellbore be drilled and at least partially lined with a string of casing or other type of wellbore liner. The casing is subsequently cemented into the wellbore to strengthen the parent wellbore and facilitate isolation of certain areas of the formation for the production of hydrocarbons. A casing exit (alternately referred to as a "window") is then created in the casing at a predetermined location to initiate the formation of a lateral wellbore. The casing exit can be formed by positioning a whipstock at the predetermined location in the parent wellbore to deflect a mill laterally to penetrate the casing and form the casing exit. A drill bit is then inserted through the casing exit to drill the lateral wellbore to a desired depth, and the lateral wellbore can then be completed as desired.

Selective isolation and/or reentry into each of the lateral wellbores is often necessary to optimize or stimulate production from the associated hydrocarbon producing formations. A typical multilateral well completion will have a reentry window assembly (alternately referred to as a lateral reentry window) installed within the parent wellbore at each lateral wellbore junction. Each reentry window assembly includes a completion sleeve (alternately referred to as a "completion window" or that provides access into the lateral wellbore from the parent wellbore. An isolation sleeve is arranged within the completion sleeve and is selectively movable to cover or expose the casing exit defined through the casing. When it is desired to enter the lateral wellbore, the isolation sleeve is moved axially within the completion sleeve to expose the casing exit and thereby allow access into the lateral wellbore with one or more downhole tools.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to multilateral wells and, more particularly, to multilateral well systems that include multiple lateral wellbores and multiple completion sleeve assemblies stacked within a parent wellbore and configured to provide flow control, pressure isolation, and lateral access (if desired) to each lateral wellbore.

Embodiments described herein are advantageous in reducing the number of required intervention trips into a multilateral well to perform maintenance on two or more lateral wellbores extending from a common parent wellbore. As described below, one or more reentry window assemblies can be installed or "stacked" in the parent wellbore at corresponding junctions of two or more lateral wellbores. Each reentry window assembly may include a completion window assembly having a window aligned with a casing exit and providing an upper coupling, a muleshoe, and upper and lower slots defined on opposing axial ends of the window. An isolation sleeve is positioned within the completion window assembly and includes a sleeve alignment key, a sleeve coupling, and an engagement device. The embodiments described herein allow a well operator to stack multiple reentry window assemblies in a multilateral well without having to pull and retrieve upper isolation sleeves to access the lower lateral wellbores, or from having telescoping isolation sleeves where lower isolation sleeves are smaller than the upper isolation sleeves.

A whipstock assembly can be conveyed into the parent wellbore to locate at least one of the reentry window assemblies. The whipstock assembly includes a whipstock and an aligning tool is operatively coupled to the whipstock. The whipstock includes one or more selective latch keys configured to mate with a unique profile provided by at least one of the sleeve profiles. Consequently, the whipstock assembly will fail to mate with a sleeve coupling that does not exhibit this unique mating profile and will, therefore, bypass the particular reentry window assembly and proceed downhole to the next reentry window assembly. The aligning tool is engageable with the muleshoe to angularly orient the whipstock to a preferred angular orientation, such as where a whipstock face is oriented to face the window. The isolation sleeve is movable between a first position, where the engagement device engages the upper coupling and the isolation sleeve occludes the window, and a second position, where the isolation sleeve engages a lower coupling and the window is exposed. While the isolation sleeve moves between the first and second positions, the sleeve alignment key interacts with the upper and lower slots and the window to maintain the isolation sleeve in a predetermined angular orientation.

Figure 1:
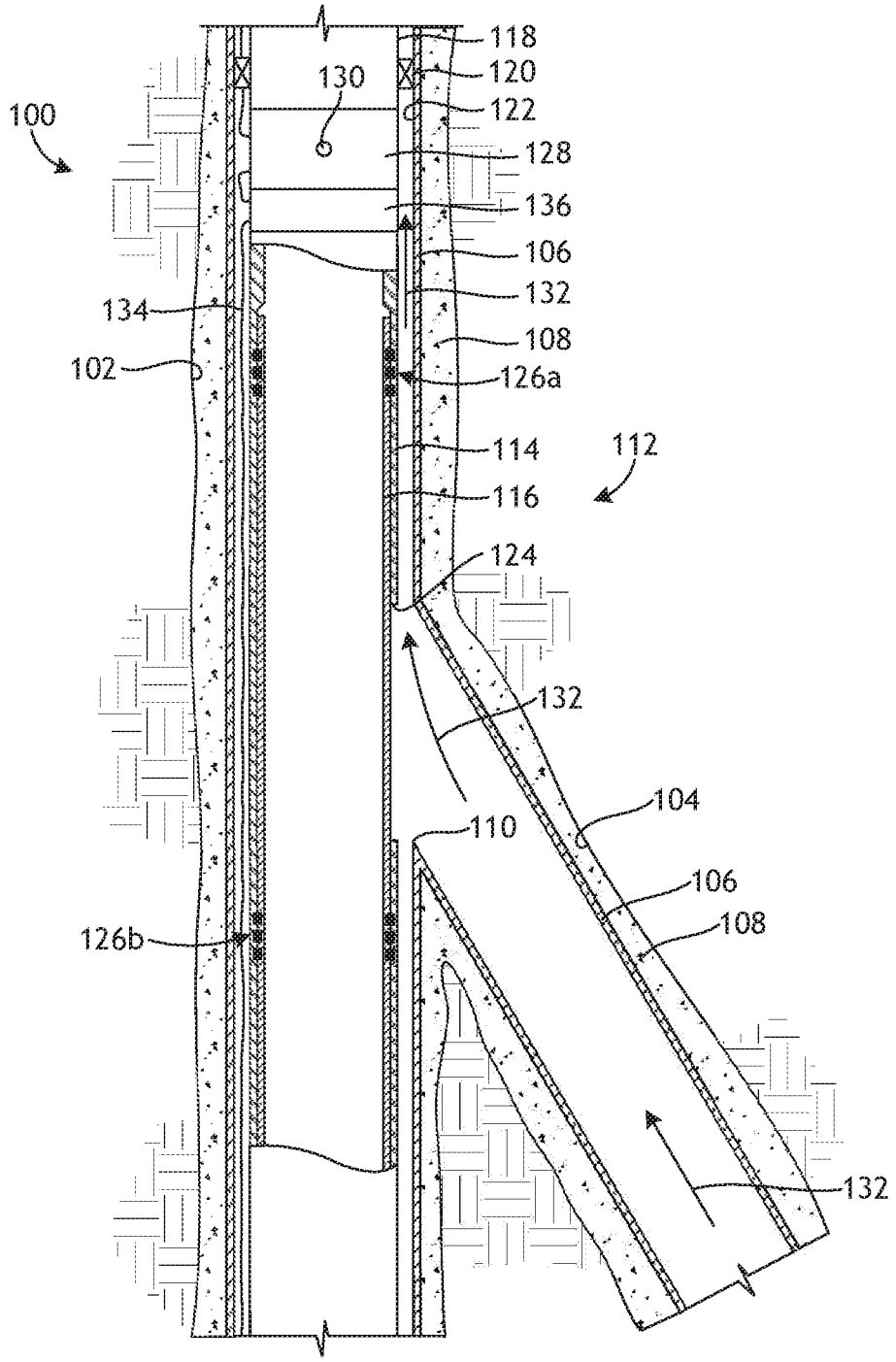
FIG. 1 is a cross-sectional side view of an exemplary well system that may incorporate the principles of the present disclosure.

FIG. 1 is a cross-sectional side view of an example well system 100 that may incorporate the principles of the present disclosure, according to one or more embodiments. As illustrated, the well system 100 may include a parent wellbore 102 and a lateral wellbore 104 that extends at an angle from the parent wellbore 102. The parent and lateral wellbores 102, 104 can alternately be referred to as primary and secondary wellbores, respectively. While only one lateral wellbore 104 is depicted in FIG. 1, the well system 100 may include multiple lateral wellbores 104 extending from the parent wellbore 102 at various locations along the depth of the parent wellbore 102. Accordingly, the well system 100 may be characterized and otherwise referred to as a "multilateral" well system.

The parent and lateral wellbores 102, 104, may be drilled and completed using conventional well drilling techniques. A liner or casing 106 may line each of the parent and lateral wellbores 102, 104 and cement 108 may be used to secure the casing 106 therein. In some embodiments, however, the casing 106 may be omitted from the lateral wellbore 104, without departing from the scope of the disclosure. A casing exit 110 may be milled, drilled, or otherwise defined through the casing 106 at the junction between the parent and lateral wellbores 102, 104. The casing exit 110 generally provides access for downhole tools to enter the lateral wellbore 104 from the parent wellbore 102.

In the illustrated embodiment, the well system 100 has been completed by installing a reentry window assembly 112 in the parent wellbore 102 that spans the casing exit 110. According to embodiments of the present disclosure, separate reentry window assemblies 112 may be installed in the parent wellbore 102 at the junction of each lateral wellbore 104 within the well system 100. As illustrated, the reentry window assembly 112 includes a completion window assembly 114 and an isolation sleeve 116 movably positioned within the interior of the completion window assembly 114.

The reentry window assembly 112 may be operatively coupled to a string of production tubing 118 that extends from a well surface location (not shown). At a point uphole from the lateral wellbore 104, one or more wellbore isolation devices 120 may be deployed in the annulus 122 defined between the production tubing 118 and the inner wall of the casing 106. The wellbore isolation device 120 provides a fluidic seal within the annulus 122 to prevent fluids from migrating past the wellbore isolation device 120 in either direction within the annulus 122.

The completion window assembly 114 axially spans the casing exit 110 and provides a window 124 azimuthally (i.e., circumferentially, angularly, radially, etc.) aligned with the casing exit 110. The window 124 provides access into the lateral wellbore 104 from the parent wellbore 102 and, more particularly, from the reentry window assembly 112. The isolation sleeve 116 is positioned within the completion window assembly 114 and comprises a generally tubular or cylindrical structure that is axially movable between a first or "closed" position and a second or "open" position. FIG. 1 depicts the isolation sleeve 116 in the first position, where the isolation sleeve 116 occludes (covers) the window 124 and thereby prevents access into the lateral wellbore 104 from the completion window assembly 114. In the second position, the isolation sleeve 116 is moved axially within the completion window assembly 114 (e.g., in the downhole direction) to expose the window 124 and thereby allow downhole tools to access the lateral wellbore 104 from the reentry window assembly 112.

An upper seal stack 126*a* and a lower seal stack 126*b* are provided to seal the interface between the completion window assembly 114 and the isolation sleeve 116. As illustrated, the upper and lower seal stacks 126*a,b* are located on opposing axial ends of the window 124. Accordingly, when in the first position, the isolation sleeve 116 fluidly isolates the interior of the completion window assembly 114 from any fluids present in the parent and lateral wellbores 102, 104.

In some embodiments, the reentry window assembly 112 may further include one or more interval control valves 128 (one shown). In some embodiments, as illustrated, the interval control valve(s) 128 may be positioned uphole from the lateral wellbore 104, but may alternatively be positioned downhole form the lateral wellbore 104. The interval control valve 128 may include one or more flow ports 130 (one shown) and may be operable or otherwise actuatable to regulate fluid flow from the lateral wellbore 104 into the production tubing 118. When the interval control valve 128 is actuated to an open configuration, formation fluids 132 originating from the lateral wellbore 104 may flow into the annulus 122 and access the production tubing 118 by flowing through the flow port(s) 130. When the interval control valve 128 is in its closed configuration, however, the formation fluids 132 are prevented from entering the production tubing 118 via the flow port(s) 130.

A communications line 134 may extend from the well surface location to communicate with the reentry window assembly 112. The communications line 134 may comprise one or more control lines, such as hydraulic, fiber optic, and electrical lines. In at least one embodiment, the communications line 134 may comprise twelve individual control lines provided in either single or flat pack configurations. In some embodiments, the communications line 134 may extend downhole past the reentry window assembly 112 to communicate with additional reentry window assemblies located further downhole within the parent wellbore 102. The communications line 134 may be configured to provide communication to downhole tools included in the reentry window assembly 112, such as the interval control valve 128. In some embodiments, the communications line 134 may operate to transmit command signals that actuate the interval control valve 128 between the open and closed configurations. Accordingly, production operations can be controlled at the surface location by communicating with the interval control valve 128 via the communications line 134.

The reentry window assembly 112 may also include one or more downhole sensors 136 used to monitor and measure a variety of downhole conditions. Example sensors that may be included in the downhole sensor(s) 136 include, but are not limited to, pressure sensors, temperature sensors, and flow rate sensors. The downhole sensor(s) 136 may be communicably coupled to the communications line 134 to provide real-time measurements of the downhole conditions to the well surface location. Based on measurements obtained by the downhole sensor(s) 136, intelligent decisions may be made with respect to the operation of the reentry window assembly 112, such as when to open or close the interval control valve 128.

As indicated above, the well system 100 may include two or more lateral wellbores 104 extending from the parent wellbore 102 and a separate reentry window assembly 112 may be installed at each junction between the parent wellbore 102 and each lateral wellbore 104. Such an arrangement is referred to as "stacking" the reentry window assemblies 112 within the parent wellbore 102. Each reentry window assembly 112 may be fluidly coupled to each other with the production tubing 118 and may be used to provide pressure isolation and access into the corresponding lateral wellbore 104. Moreover, a separate interval control valve 128 may be included in each reentry window assembly 112 and used to control production operations from each lateral wellbore 104. Downhole sensors 136 may also be included in each reentry window assembly 112 at or near each lateral wellbore 104 and used to provide real-time measurements of downhole conditions at each downhole location. This information may be provided to a well operator via the communications line 134 to allow the well operator to make intelligent production decisions as to which lateral wellbore 104 should be produced or shut for hydrocarbon extraction.

Figure 2:
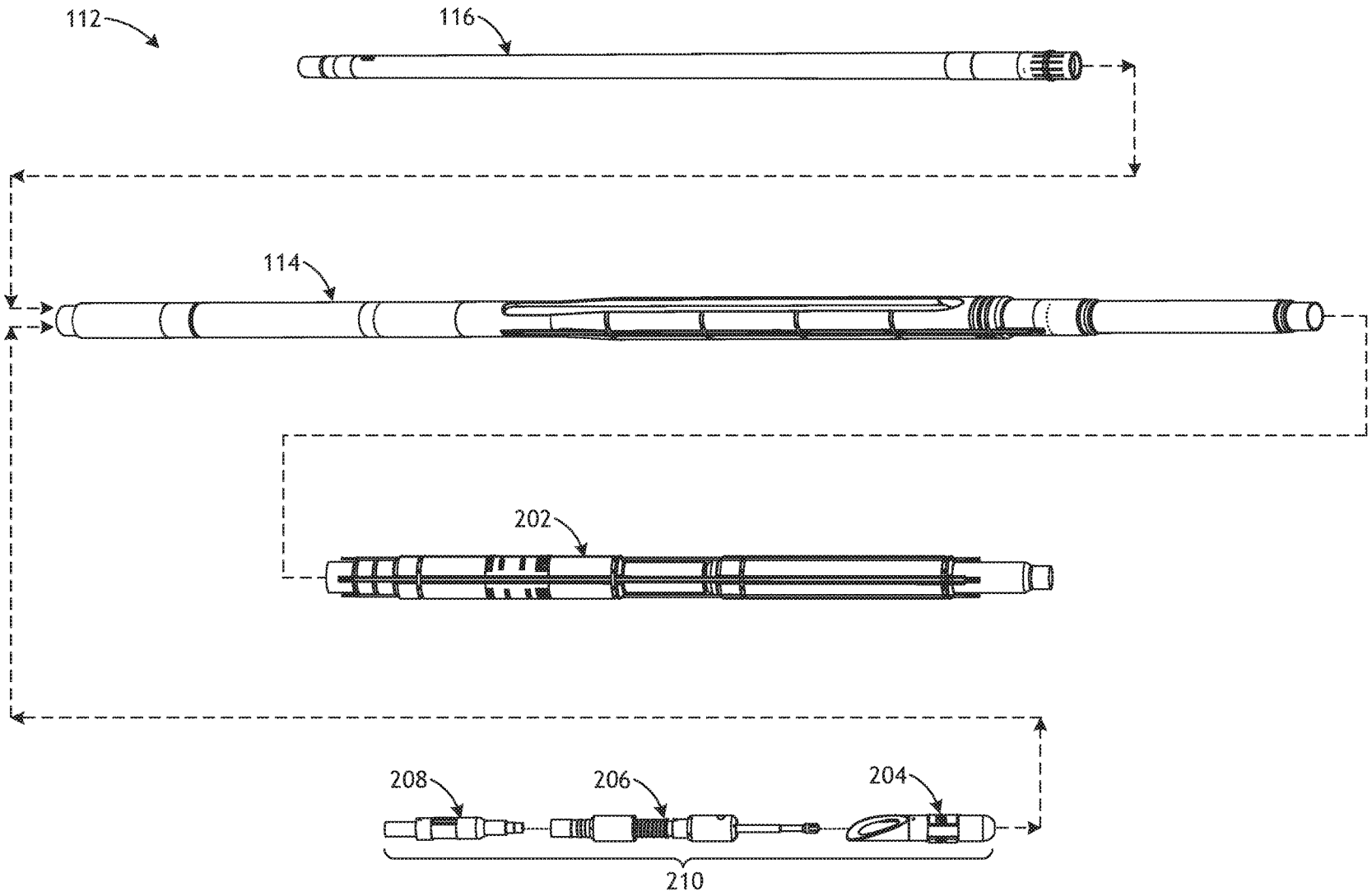
FIG. 2 is an exploded view of some of the component parts of the reentry window assembly of FIG. 1.

FIG. 2 depicts an exploded view of some of the component parts of the reentry window assembly 112, according to one or more embodiments. More particularly, FIG. 2 depicts embodiments of the completion window assembly 114, the isolation sleeve 116, a latch assembly 202, a whipstock 204 (alternately referred to as a tubing exit whipstock or "TEW"), a running tool 206 for the whipstock 204, and an aligning tool 208 for the whipstock 204.

Briefly, the isolation sleeve 116 is configured to be received within the interior of the completion window assembly 114 and moved between closed and open positions to occlude or expose the window 124. The latch assembly 202 is configured to be coupled the downhole end of the completion window assembly 114 and operable to axially and azimuthally align the window 124 relative to the casing exit 110 (FIG. 1) defined in the casing 106 (FIG. 1). The whipstock 204, the running tool 206, and the aligning tool 208 are generally coupled end to end and are cooperatively referred to herein as a whipstock assembly 210. The whipstock assembly 210 is run downhole on a conveyance (e.g., coiled tubing) coupled to the uphole end of the aligning tool 208. The whipstock assembly 210 is run downhole to locate and extend into the completion window assembly 114. In some embodiments, upon entering the completion window assembly 114, the whipstock 204 may be operatively coupled to and move the isolation sleeve 116 to the open position where the whipstock 204 will be positioned within the completion window assembly 114 to deflect one or more downhole tools through the window 124 and into the lateral wellbore 104 (FIG. 1). In other embodiments, however, the isolation sleeve 116 may be moved to the open position with a shifting tool or the like prior to running the whipstock assembly 210 downhole. The running tool 206 and the aligning tool 208 may be configured to axially and azimuthally align the whipstock 204 with the window 124 to enable to the downhole tools to accurately locate the lateral wellbore 104.

Figure 3:
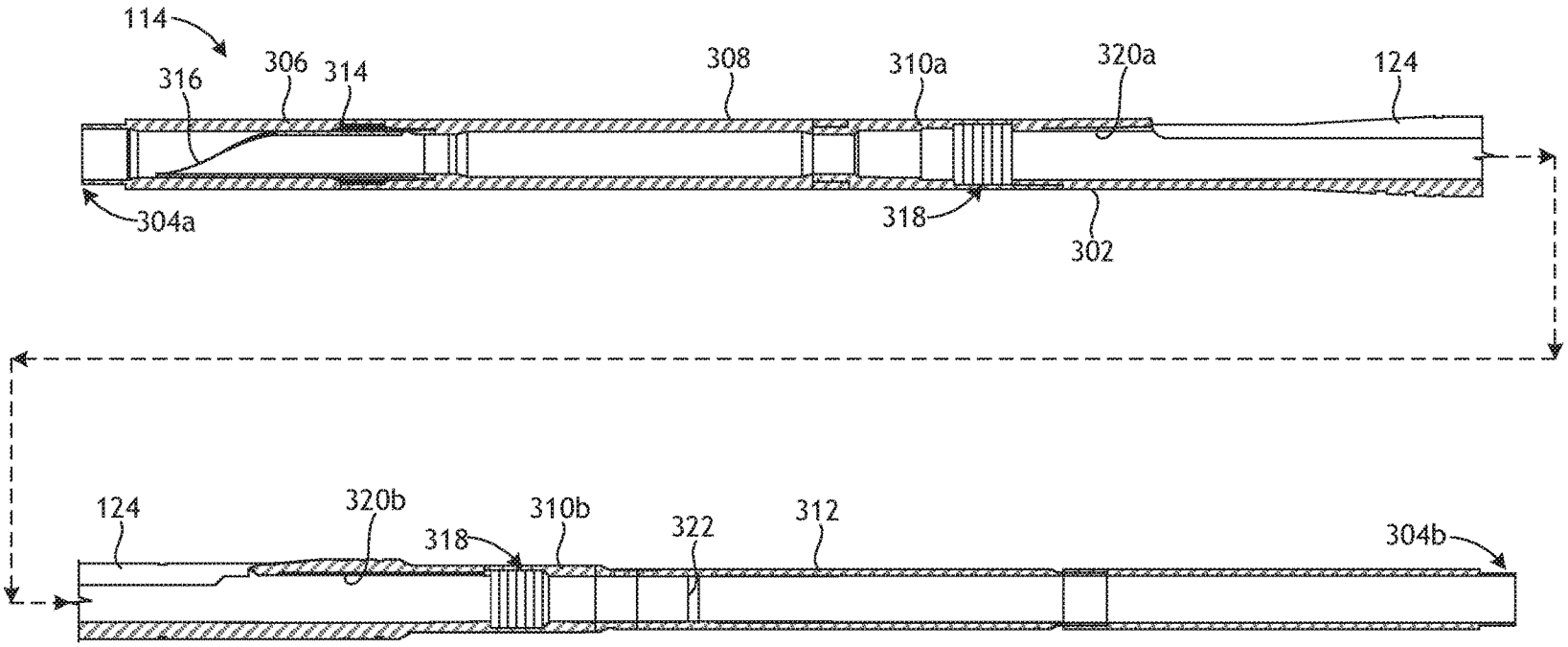
FIG. 3 is a cross-sectional side view of the completion sleeve of FIGS. 1 and 2.

FIG. 3 is a cross-sectional side view of the completion window assembly 114 of FIGS. 1 and 2, according to one or more embodiments. The completion window assembly 114 may be run into the parent wellbore 102 (FIG. 1) on a string of tubing and installed within the casing 106 (FIG. 1) at the junction between the parent and lateral wellbores 102, 104 (FIG. 1). The completion window assembly 114 will be installed after the casing exit 110 (FIG. 1) has been milled and the lateral wellbore 104 has been drilled to a desired depth. The completion window assembly 114 provides the support required to shift the isolation sleeve 116 "up" or "down" to isolate the lateral wellbore 104 or provide downhole tool access into the lateral wellbore 104.

The completion window assembly 114 provides a first or "uphole" end 304*a* and a second or "downhole" end 304*b* opposite the first end 304*a*. As illustrated, the completion window assembly 114 may include various component parts, including a completion sleeve 302, a muleshoe housing 306, a spacer tube 308, an upper seal housing 310*a*, a lower seal housing 310*b*, and a tail pipe 312. The muleshoe housing 306 may be positioned at or near the uphole end 304*a* and a muleshoe 314 may be positioned within the muleshoe housing 306. The muleshoe 314 provides and otherwise defines a muleshoe profile 316 that helps azimuthally align the whipstock 204 (FIG. 7), as will be described below. The spacer tube 308 may provide a tubular length of the completion window assembly 114 where azimuthal alignment of the whipstock 204 can occur.

The window 124 is defined in the completion sleeve 302, and the upper and lower seal housings 310*a,b* are positioned on opposing axial ends of the completion sleeve 302. Each seal housing 310*a,b* includes one or more seal elements 318 (referred to in FIG. 1 as upper and lower seal stacks 126*a,b*), which may comprise a variety of sealing devices that, in some embodiments, operate as dynamic seals. As used herein, the term "dynamic seal" refers to a seal that provides pressure and/or fluid isolation between members that have relative displacement therebetween, for example, a seal that seals against a displacing surface, or a seal carried on one member and sealing against the other member while both members are stationary or one member is moving with respect to the other. As described herein, the isolation sleeve 116 (FIG. 4) may be configured to translate axially within the completion window assembly 114 and the seal elements 318 may be configured to "dynamically" seal against the outer surface of the isolation sleeve 116 as the isolation sleeve 116 moves. The seal elements 318 sealingly engage the isolation sleeve 116 and are able to withstand burst and collapse ratings to effectively isolate the lateral wellbore 104 (FIG. 1).

The seal elements 318 may be made of a variety of materials including, but not limited to, an elastomeric material, a rubber, a metal, a composite, a ceramic, any derivative thereof, and any combination thereof. In some embodiments, as illustrated, the seal elements 318 may comprise O-rings or the like. In other embodiments, however, the seal elements 318 may comprise a set of v-rings, or another appropriate seal configuration (e.g., seals that are round, v-shaped, u-shaped, square, oval, t-shaped, etc.), as generally known to those skilled in the art. One or more of the seal elements 318 may alternatively comprise a molded rubber or elastomeric seal, a metal-to-metal seal (e.g., O-ring, crush ring, crevice ring, up stop piston type, down stop piston type, etc.), or any combination of the foregoing.

While the seal elements 318 (i.e., the upper and lower seal stacks 126*a,b* of FIG. 1) are described and illustrated as being positioned within the seal housings 310*a,b*, it will be appreciated that the seal elements 318 may alternatively be included on the isolation sleeve 116 (FIG. 4) and configured to "dynamically" seal against the inner diameter of the completion sleeve 302.

Figure 4:
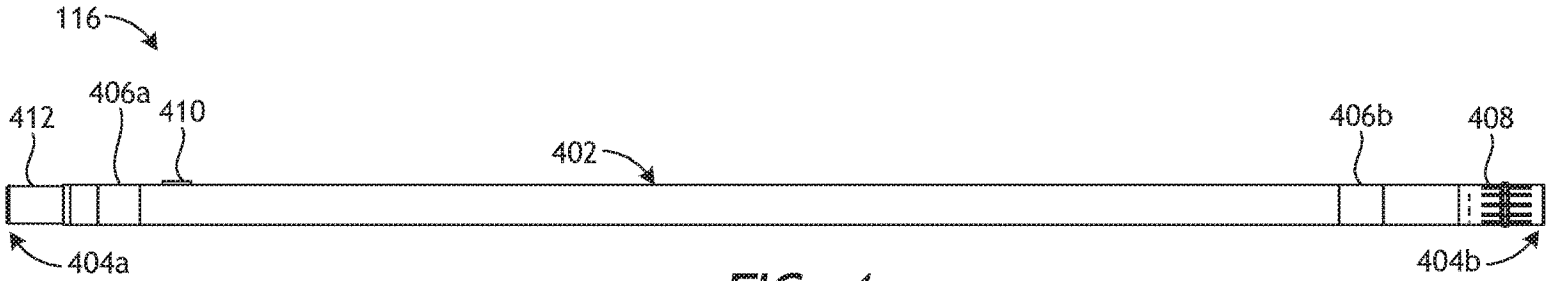
FIG. 4 is a side view of the isolation sleeve of FIGS. 1 and 2.

The completion window assembly 114 may further provide an upper slot 320*a*, a lower slot 320*b*, and an upper coupling 322. The upper and lower slots 320*a,b* are defined in the completion sleeve 302 on opposing axial ends of the window 124 and, as discussed further below, may be used to help azimuthally align the isolation sleeve 116 (FIG. 4). The upper coupling 322 may be defined on the inner surface of the tailpipe 312 and configured to receive an engagement device provided by the isolation sleeve 116. In some embodiments, the engagement device of the isolation sleeve 116 may comprise a collet, and the upper coupling 322 may, therefore, comprise a collet profile configured to receive the collet. With the engagement device received within the upper coupling 322, the isolation sleeve 116 will be axially fixed within the completion window assembly 114 in the closed position.

FIG. 4 is a side view of the isolation sleeve 116, according to one or more embodiments. The isolation sleeve 116 comprises an elongate body 402 having an uphole end 404*a* and a downhole end 404*b* opposite the uphole end 404*a*. The isolation sleeve 116 is sized to be received within the interior of the completion window assembly 114 (FIG. 3) and may be used to provide pressure isolation from the lateral wellbore 104 (FIG. 1) via the window 124 (FIG. 3).

The body 402 may provide and otherwise define an upper seal surface 406*a* and a lower seal surface 406*b*. The upper and lower seal surfaces 406*a,b* may be arranged along the axial length of the body 402 to align with the upper and lower seal housings 310*a,b* (FIG. 3) when the isolation sleeve 116 is in the closed position. In the closed position, the seal elements 318 (FIG. 3) of the upper and lower seal housings 310*a,b* are able to sealingly engage the upper and lower seal surfaces 406*a,b*, respectively. As indicated above, however, it is also contemplated herein to have the seal elements 318 included on the isolation sleeve 116 and configured to "dynamically" seal against the inner diameter of the completion sleeve 302, without departing from the scope of the disclosure.

An engagement device 408 may be provided on the body 402 at or near the downhole end 404*b*. The engagement device 408 may be configured to releasably secure the isolation sleeve 116 in the closed and open positions within the completion window assembly 114 (FIG. 3). The engagement device 408 may be configured to locate and be received within the upper coupling 322 (FIG. 3) of the completion window assembly 114 to axially secure the isolation sleeve 116 in the closed position. In at least one embodiment, the engagement device 408 may comprise a snap collet that includes a plurality of flexible collet fingers. In other embodiments, however, the engagement device 408 may comprise any type of mechanism capable of releasably engaging the completion window assembly 114 at the upper coupling 322.

If access into the lateral wellbore 104 (FIG. 1) is desired, the isolation sleeve 116 is not removed from the completion window assembly 114 (FIG. 3) and retrieved (returned) to the well surface from the parent wellbore 102 (FIG. 1). Instead, the isolation sleeve 116 is configured to be axially shifted within the completion window assembly 114 from the closed position to the open position. When pressure isolation from the lateral wellbore 104 is required once again, the isolation sleeve 116 will be shifted back up to the closed position, where the seal elements 318 of the upper and lower seal housings 310*a,b* (FIG. 3) again seal against the upper and lower seal surfaces 406*a,b*, respectively.

The isolation sleeve 116 may be designed to be properly oriented at all times when installed inside the completion window assembly 114 (FIG. 3). Proper orientation of the isolation sleeve 116 may be possible due to a sleeve alignment key 410 provided by and otherwise defined on the outer surface of the body 402 and extending radially outward therefrom. The sleeve alignment key 410 may be configured to interact with the upper and lower slots 320*a,b* (FIG. 3) of the completion window assembly 114, which help guide and maintain the isolation sleeve 116 in a predetermined angular orientation. More particularly, in the closed position (i.e., when the isolation sleeve 116 is shifted up relative to the completion window assembly 114), the sleeve alignment key 410 will extend radially through and into the upper slot 320*a*. In the open position (i.e., when the isolation sleeve 116 is shifted down relative to the completion window assembly 114), the sleeve alignment key 410 will extend radially through and into the lower slot 320*b*. As the isolation sleeve 116 translates between the closed and open positions, the sleeve alignment key 410 may extend radially into the window 124 (FIG. 3), which also helps guide the isolation sleeve 116 so that it is maintained in the proper azimuthal orientation.

Properly orienting the isolation sleeve 116 at all times when installed inside the completion window assembly 114 (FIG. 3) proves useful in helping to properly orient the whipstock 204 (FIG. 7), which is configured to be coupled to the isolation sleeve 116 at a sleeve coupling 412. The sleeve coupling 412 is positioned at or near the uphole end 404*a* of the body 402 and may be configured to receive and secure the whipstock 204 (FIG. 7) in predetermined axial and azimuthal (radial) orientations. The whipstock 204 needs to be azimuthally oriented in a manner where its deflector is angularly aligned with the window 124 (FIG. 3) of the completion window assembly 114 to facilitate proper exit of downhole tools out of the completion window assembly 114.

Figure 5B:
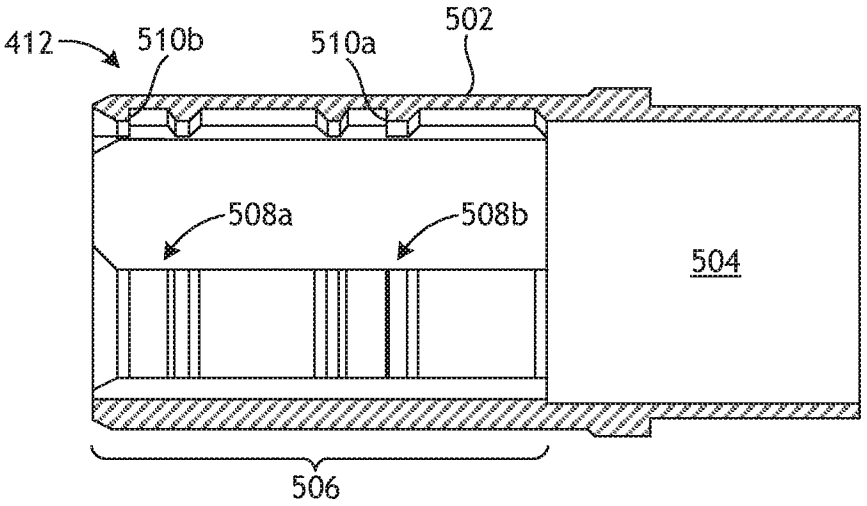
FIGS. 5A and 5B are isometric and cross-sectional side views, respectively, of the sleeve coupling of FIG. 4.
Figure 5A:
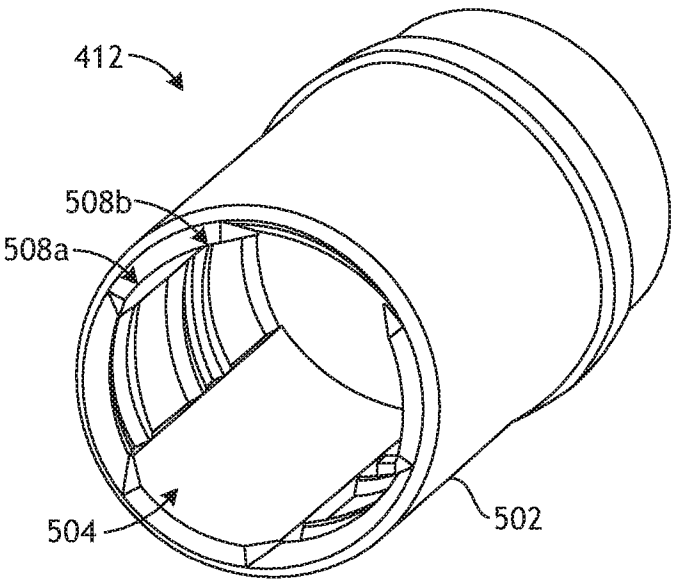
Figure 7:
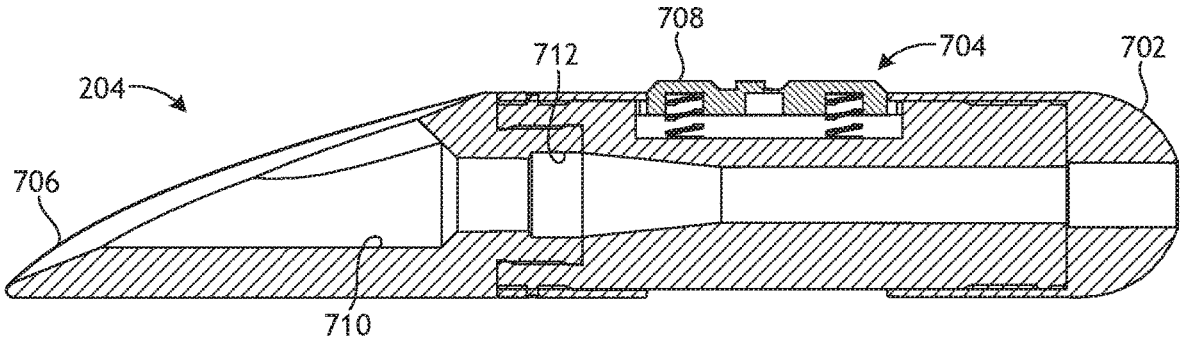
FIG. 7 is a cross-sectional side view of the whipstock of FIG. 2.

FIGS. 5A and 5B are isometric and cross-sectional side views of the sleeve coupling 412, respectively. As illustrated, the sleeve coupling 412 comprises a generally cylindrical body 502 that provides an interior 504. An inner profile 506 is defined on the inner radial surface of the sleeve coupling 412 and provides a unique pattern configured to receive a selective latch key of the whipstock 204 (FIG. 7). In some embodiments, for example, a plurality of isolation sleeves similar in some respects to the isolation sleeve 116 (FIG. 4) may be employed in a multilateral well system (e.g., the well system 100 of FIG. 1) with a corresponding plurality of completion sleeves arranged in a stacked configuration at corresponding junctions between the parent wellbore 102 (FIG. 1) and associated lateral wellbores (FIG. 1). In such embodiments, a whipstock conveyed downhole may be configured to selectively latch into and move only a matching isolation sleeve based on the unique pattern of the inner profile 506 and bypass the other isolation sleeves.

As illustrated, the inner profile 506 may provide an upper inner profile 508*a* and a lower inner profile 508*b* axially offset from each other along the inner radial surface. The upper and lower inner profiles 508*a,b* each defines one or more arcuate protrusions or grooves configured to mate with the selective latch key of the whipstock 204 (FIG. 7) and thereby allow the whipstock 204 to move the isolation sleeve 116 between the closed and open positions. The lower inner profile 506*b*, for example, includes an uphole-facing shoulder 510*a* that faces uphole (i.e., to the left in FIG. 5B), and the upper inner profile 508*a* includes a downhole-facing shoulder 510*b* that faces downhole (i.e., to the right in FIG. 5B). The selective latch key of the whipstock 204 may be able to locate and push against the uphole-facing shoulder 510*a* in the downhole direction to move the isolation sleeve 116 toward the open position. Alternatively, the selective latch key of the whipstock 204 may be able to locate and push against the downhole-facing shoulder 510*b* in the uphole direction to move the isolation sleeve 116 toward the closed position.

Figure 6:
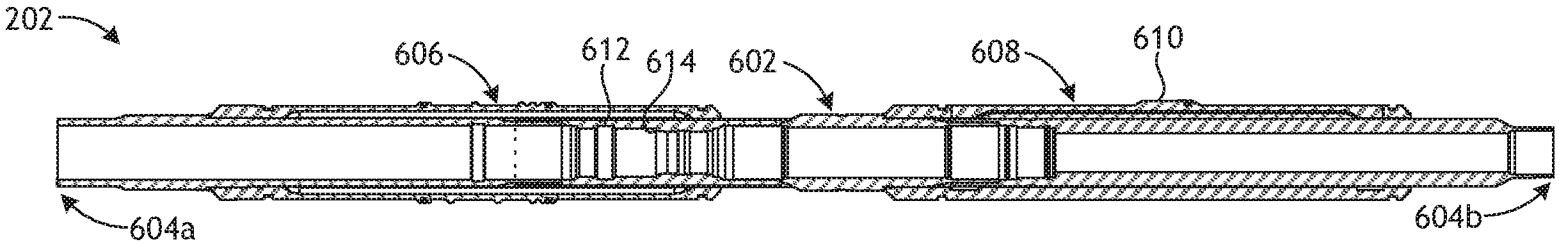
FIG. 6 is a cross-sectional side view of the latch assembly of FIG. 2.

FIG. 6 is a cross-sectional side view of the latch assembly 202 of FIG. 2, according to one or more embodiments. As illustrated, the latch assembly 202 comprises an elongate body 602 that has a first or "uphole" end 604*a* and a second or "downhole" end 604*b* opposite the uphole end 604*a*. The uphole end 604*a* of the latch assembly 202 may be configured to be coupled to the downhole end 304*b* (FIG. 3) of the completion window assembly 114 (FIG. 3) and run into the parent wellbore 102 (FIG. 1) with the completion window assembly 114.

The latch assembly 202 serves to axially and radially fix the completion window assembly 114 (FIG. 3) in a desired axial and rotational orientation within the parent wellbore 102. To accomplish this, the latch assembly 202 includes one or more latch keys 606 and an alignment sub 608. The latch keys 606 exhibit a unique outer profile configured to locate and engage a corresponding unique internal latch profile of a latch coupling forming part of the casing 106 (FIG. 1) in the parent wellbore 102 (FIG. 1). This enables selective engagement of the latch keys 606 with a matching or mating latch profile and thus allows for the placement of multiple reentry systems 112 (FIG. 2). The internal latch profile of the latch coupling may include, for example, a plurality of axially spaced grooves used to receive the latch keys 606 and thereby axially orient the latch assembly 202 within the parent wellbore 102.

The alignment sub 608 may include an alignment key 610 configured to locate and engage a muleshoe forming part of the casing 106 (FIG. 1). As the latch assembly 202 is run into the parent wellbore 102 (FIG. 1), the alignment key 610 will locate and engage the muleshoe, which serves to angularly rotate the latch assembly 202 and, therefore, the completion window assembly 114 (FIG. 3) within the parent wellbore 102 to the proper azimuthal (circumferential) orientation relative to the casing 106. Accordingly, once the latch keys 606 are received by the latch coupling, the completion window assembly 114 will be axially and azimuthally oriented within the parent wellbore 102.

The latch assembly 202 may also include a lower coupling 612 defined on its inner radial surface. Similar to the upper coupling 322 (FIG. 3) of the completion window assembly 114 (FIG. 3), the lower coupling 612 may be configured to receive the engagement device 408 (FIG. 4) of the isolation sleeve 116 (FIG. 4). The lower coupling 612 may be configured to receive the engagement device 408 when the isolation sleeve 116 has been moved to the open position and thereby axially fix the isolation sleeve 116 in the open position. In some embodiments, the latch assembly 202 may further define or otherwise provide a no-go shoulder 614 defined on the inner radial surface of the body 602. The no go shoulder 614 may be used to stop axial movement of the isolation sleeve 116 as it moves to the open position.

FIG. 7 is a cross-sectional side view of the whipstock 204 of FIG. 2, according to one or more embodiments. The main purpose of the whipstock 204 is to deflect downhole tools into the lateral wellbore 104 (FIG. 1) when intervention into the lateral wellbore 104 is required in the well system 100 (FIG. 1). As illustrated, the whipstock 204 may include a bullnose 702, a latch key assembly 704, and a whipstock face 706. The rounded features of the bullnose 702 help the whipstock 204 enter the interior of the completion window assembly 114 (FIG. 3) and the isolation sleeve 116 (FIG. 4) without catching on corners or shoulders as the whipstock 204 is conveyed downhole.

The latch key assembly 704 may include one or more selective latch keys 708 (one shown) having a unique profile design configured to locate and engage the inner profile 506 (FIGS. 5A-5B) of the sleeve coupling 412 (FIGS. 4 and 5A-5B). In some embodiments, the latch key(s) 708 may be spring-loaded and thereby able to snap into and out of engagement with the inner profile 506 under sufficient axial loading applied to the whipstock 204. It is noted that because of its unique profile design, the spring-loaded latch key(s) 708 are "selective" in that they are configured to bypass inner profiles of other isolation sleeves that do not match the unique profile pattern of the inner profile 506. As will be appreciated, this may allow a well operator to employ multiple stacked reentry window assemblies 112 (FIG. 2) within a multilateral well system (e.g., the well system 100 of FIG. 1).

The whipstock face 706 may comprise a slanted or angled surface configured to engage and divert downhole tools into the lateral wellbore 104 (FIG. 1) when the isolation sleeve 116 (FIG. 4) is moved to the open position. The whipstock face 706 may further define a central passage 710 and an inner profile 712 may be defined in the central passage 710. As described below, the central passage 710 may receive a mandrel of the running tool 206, and the inner profile 712 may help secure the mandrel to the whipstock 204.

As described below, the whipstock 204 will be azimuthally (circumferentially) oriented before it is coupled to the sleeve coupling 412 (FIGS. 4 and 5A-5B) of the isolation sleeve 116 (FIG. 4). Accordingly, once the latch keys 708 mate with the inner profile 506 (FIGS. 5A-5B) of the sleeve coupling 412, the whipstock 204 will be radially oriented in the proper orientation. As will be appreciated, this may be important since the whipstock face 706 will be angularly oriented toward the window 124 (FIG. 3) when the isolation sleeve 116 is shifted to the open position. As a result, the whipstock face 706 will be ready to deviate (deflect) downhole tools to the lateral wellbore 104 (FIG. 1) through the window 124 (FIG. 3) and the casing exit 110 (FIG. 1). Once installed in the isolation sleeve 116, the whipstock 204 will provide the axial load required to shift the isolation sleeve 116 between the closed and open positions.

Figure 8A:
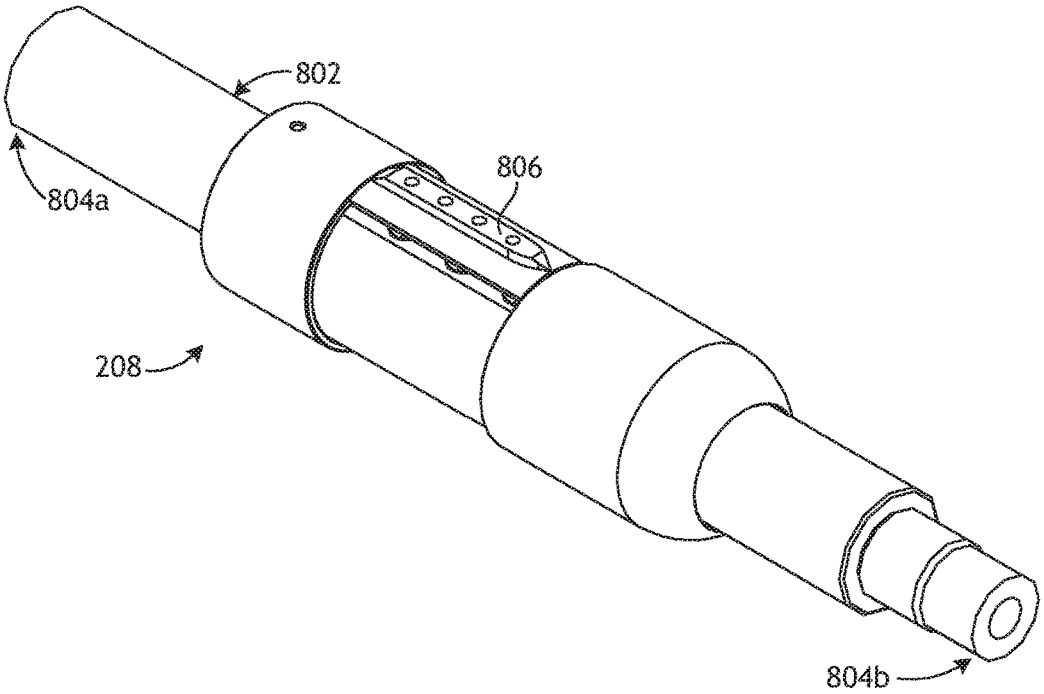
FIGS. 8A and 8B are isometric and cross-sectional side views, respectively, of the aligning tool of FIG. 2.
Figure 8B:
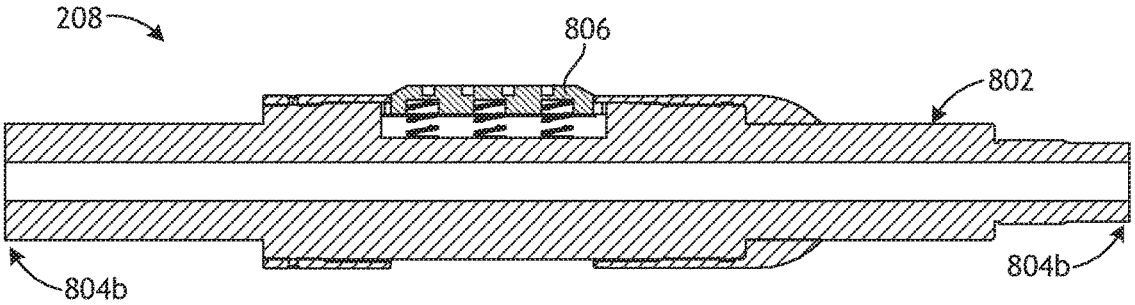

FIGS. 8A and 8B are isometric and cross-sectional side views, respectively, of the aligning tool 208 of FIG. 2, according to one or more embodiments. As illustrated, the aligning tool 208 provides a body 802 having an upper end 804*a* and a lower end 804*b* opposite the upper end 804*a*. As indicated above, the aligning tool 208, the running tool 206 (FIGS. 2 and 9A-9C) and the whipstock 204 (FIG. 7) are coupled end to end and run into the parent wellbore 102 (FIG. 1) on a conveyance, such as coiled tubing. The conveyance may be coupled to the upper end 804*a* of the body 802, for example.

The main purpose of the aligning tool 208 is to angularly orient the whipstock 204 (FIG. 7) so that the whipstock face 706 (FIG. 7) will be angularly oriented toward the window 124 (FIG. 3) when the isolation sleeve 116 (FIG. 4) is shifted to the open position. To accomplish this, the aligning tool 208 may be operatively coupled to the running tool 206 (FIGS. 2 and 9A-9C) at the lower end 804*a*, and the running tool 206 is, in turn, operatively coupled to the whipstock 204 such that angular rotation of the aligning tool 208 correspondingly rotates the whipstock 204. Moreover, the alignment tool 208 includes an alignment key 806 configured to locate and engage the muleshoe profile 316 (FIG. 3) of the muleshoe 314 (FIG. 3) positioned within the completion window assembly 114 (FIG. 3). As the aligning tool 208, the running tool 206, and the whipstock 204 (i.e., the whipstock assembly 210) are run into the parent wellbore 102 (FIG. 1), the alignment key 806 will eventually locate and engage the muleshoe profile 316. Since the completion window assembly 114 has already been properly oriented, as discussed above, the muleshoe profile 316 is already positioned to receive the alignment key 806 and angularly rotate the aligning tool 208 and, therefore, the whipstock 204 to the proper azimuthal (circumferential) orientation.

In some embodiments, the alignment key 806 may be spring-loaded and, therefore, able to radially contract (compress) when necessary to bypass downhole restrictions. Moreover, while not shown, a swivel-free rotating mechanism may be coupled to the aligning tool 208 at the upper end 804*a* to allow the aligning tool 208 the free angular rotation relative to the conveyance used to run the aligning tool 208 downhole and needed to properly orient the whipstock 204 (FIG. 7).

Figure 9A:
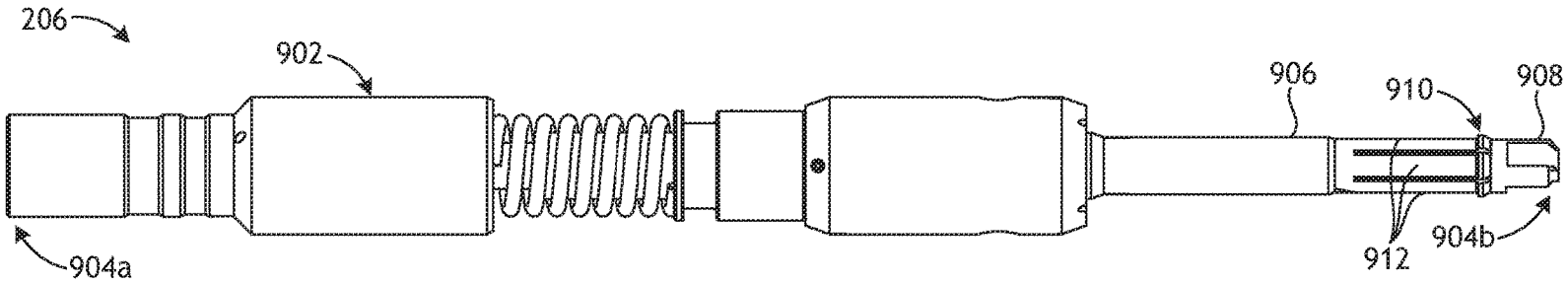
FIGS. 9A-9C depict various views of the running tool of FIG. 2.
Figure 9B:
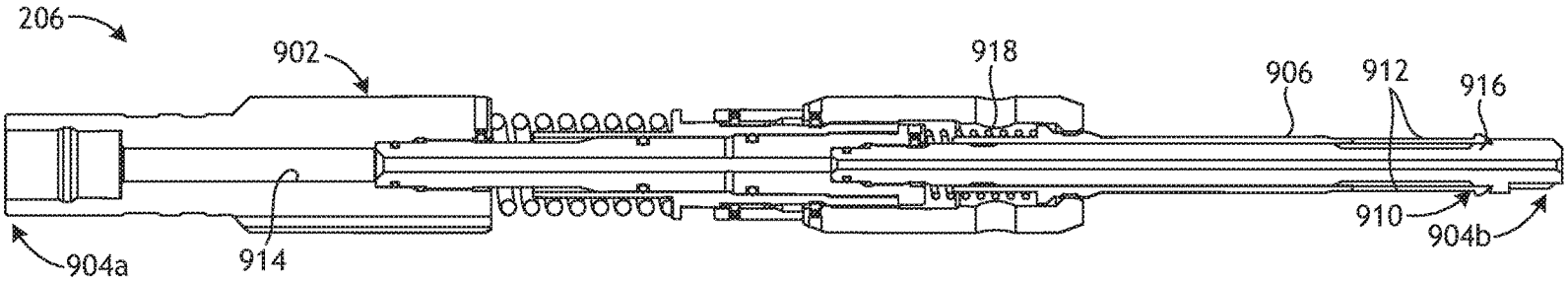
Figure 9C:
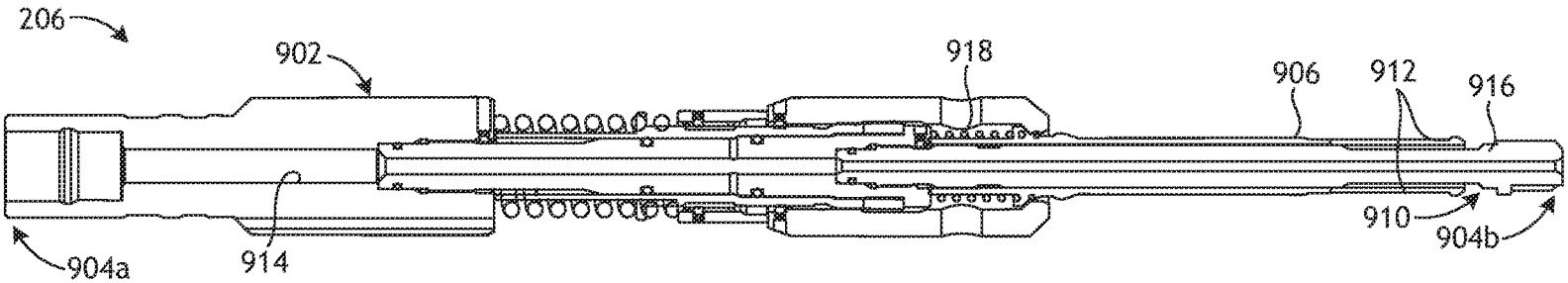

FIGS. 9A-9C depict various views of the running tool 206 of FIG. 2, according to one or more embodiments. More specifically, FIG. 9A is a side view of the running tool 206, FIG. 9B is a cross-sectional side view of the running tool 206 in an engaged configuration, and FIG. 9C is a cross-sectional side view of the running tool 206 in a released configuration. As illustrated, the running tool 206 provides an elongate body 902 having an upper end 904*a* and a lower end 904*b* opposite the upper end 904*a*.

The upper end 904*a* of the running tool 206 may be coupled to the lower end 804*b* (FIGS. 8A and 8B) of the aligning tool 208 (FIGS. 8A and 8B), and the lower end 904*b* of the running tool 206 may be coupled to the whipstock 204 (FIG. 7). A mandrel 906 may be proved at or near the lower end 904*b* and the mandrel 906 is configured to extend axially into the central passage 710 (FIG. 7) of the whipstock 204. A tool profile 908 is provided at the lower end 904*b*, and an engagement device 910 is provided on the downhole end of the mandrel 906 near the lower end 904*b*. In some embodiments, the tool profile 908 may comprise a square shoulder configured to engage a corresponding square shoulder or profile provided within the central passage 710. With the tool profile 908 mated with the corresponding square shoulder or profile, the running tool 206 will be radially fixed relative to the whipstock 204. Therefore, if the running tool 206 rotates, the whipstock 204 will correspondingly rotate. Moreover, the tool profile 908 may provide the required surface area to allow the running tool 206 to axially move the whipstock 204 downhole.

The engagement device 910 may be configured to releasably secure the running tool 206 to the whipstock 204 (FIG. 7) by locating and being received within the inner profile 712 (FIG. 7) defined in the central passage 710 (FIG. 7). With the engagement device 910 received within the inner profile 712, the running tool 206 will be axially fixed to the whipstock 204. In at least one embodiment, the engagement device 910 may comprise a snap collet that includes a plurality of flexible collet fingers 912. In other embodiments, however, the engagement device 910 may comprise any type of mechanism capable of releasably engaging the running tool 206 at the inner profile 712. The engagement device 910 will support the weight of the whipstock 204 (when hanging) and will also help pull the whipstock 204 in the uphole direction when required.

With specific reference to FIGS. 9B and 9C, the running tool 206 is operable based on hydraulic pressure conveyed through a central passageway 914 defined through the body 902. To release the running tool 206 from the whipstock 204 (FIG. 7), the running tool 206 needs to be moved from the engaged configuration (FIG. 9B) to the released configuration (FIG. 9C). In the engaged configuration, the collet fingers 912 are radially supported by a radial shoulder 916 defined by the body 902 and, therefore, unable to disengage from the inner profile 712 (FIG. 7) defined in the central passage 710 (FIG. 7) of the whipstock 204. To move the running tool 206 to the released configuration, the central passageway 914 is pressurized, which creates a pressure differential across the mandrel 906 that urges the mandrel 906 toward the upper end 904*a* relative to the body 902. As the mandrel 906 moves toward the upper end 904*a*, an internal biasing device 918 interposing the mandrel 906 and an end wall 920 defined on the body 902 is compressed. Moreover, as the mandrel 906 moves toward the upper end 904*a*, the collet fingers 912 move out of radial alignment with the radial shoulder 916, which leaves the collet fingers 912 radially unsupported. With the collet fingers 912 radially unsupported, the running tool 206 may be pulled uphole (i.e., to the left in FIGS. 9B-9C) and the collet fingers 912 will radially contract and snap out of engagement with the inner profile 712.

The installation and example operation of the reentry window assembly 112 of FIG. 2 is now provided with reference to the following several figures. Similar reference numerals from prior figures that are used in the following figures correspond to similar components or elements of the reentry window assembly 112 that may not be described or defined again in detail.

The installation of the reentry window assembly 112 within the parent wellbore 102 (FIG. 1) takes place after several downhole operations have already been completed within the well system 100 (FIG. 1). For example, the parent wellbore 102 will have already been drilled to total depth, corresponding casing exits 110 (FIG. 1) will have already be formed through the casing 106 (FIG. 1) for two or more lateral wellbores 104 (FIG. 1), and the two or more lateral wellbores 104 will also have already been drilled to total depth. Moreover, the cementing and casing operations will have already been completed in one or both of the parent wellbore 102 and the lateral wellbore(s) 104, and latch couplings and corresponding muleshoes will have been already installed and properly oriented in the casing 106 to receive the latch assembly 202 (FIG. 6). As discussed above, such latch couplings and corresponding muleshoes may be used to help axially and radially fix the completion window assembly 114 (FIG. 3) in a desired axial and angular orientation within the parent wellbore 102. In some embodiments, a cleaning run into the parent wellbore 102 might be required to remove debris from the internal latch profile of the latch coupling(s) and the latch muleshoe.

Two or more reentry window assemblies 112 may be installed in the parent wellbore 102 (FIG. 1) to provide a "stacked" relationship where each reentry window assembly 112 is installed at the junction of a corresponding lateral wellbore 104 (FIG. 1). Each reentry window assembly 112 may be coupled to or otherwise include a separate interval control valve 128 (FIG. 1) to control the flow of fluids from the corresponding lateral wellbore 104. Moreover, the communications line 134 (FIG. 1) may extend into the parent wellbore 102 from a well surface location and communicate with each reentry window assembly 112.

Figure 10:
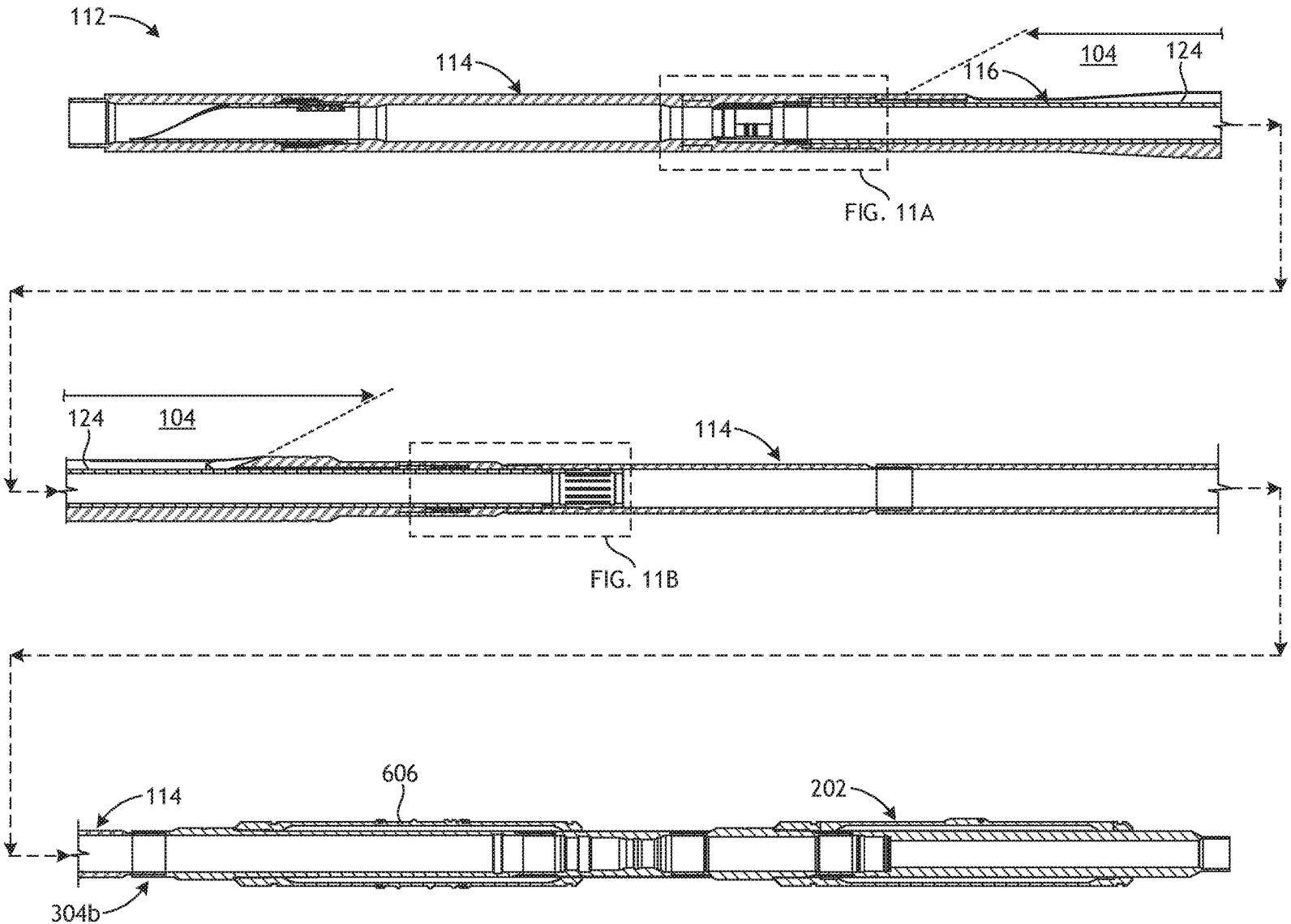
FIG. 10 is a cross-sectional side view of the reentry window assembly with the isolation sleeve installed within the completion sleeve.

FIG. 10 is a cross-sectional side view of the reentry window assembly 112 as would be installed downhole in a wellbore (e.g., the parent wellbore 102 of FIG. 1). As illustrated, the window 124 defined in the completion window assembly 114 is axially aligned with the lateral wellbore 104, which is generally depicted by dashed lines. The isolation sleeve 116 is installed within the completion window assembly 114 in the closed position and thereby axially spans and occludes the window 124. Moreover, the latch assembly 202 is coupled to the downhole end 304*b* of the completion window assembly 114. The reentry window assembly 112 is installed downhole (e.g., in the casing 106 of FIG. 1) by allowing the latch keys 606 to locate and engage a corresponding unique internal latch profile of a latch coupling (not shown) already installed downhole, such as forming part of the casing 106 of FIG. 1. Once the latch keys 606 are received by the latch coupling, the window 124 will be axially and azimuthally oriented to a desired orientation relative to the lateral wellbore 104.

Figure 11A:
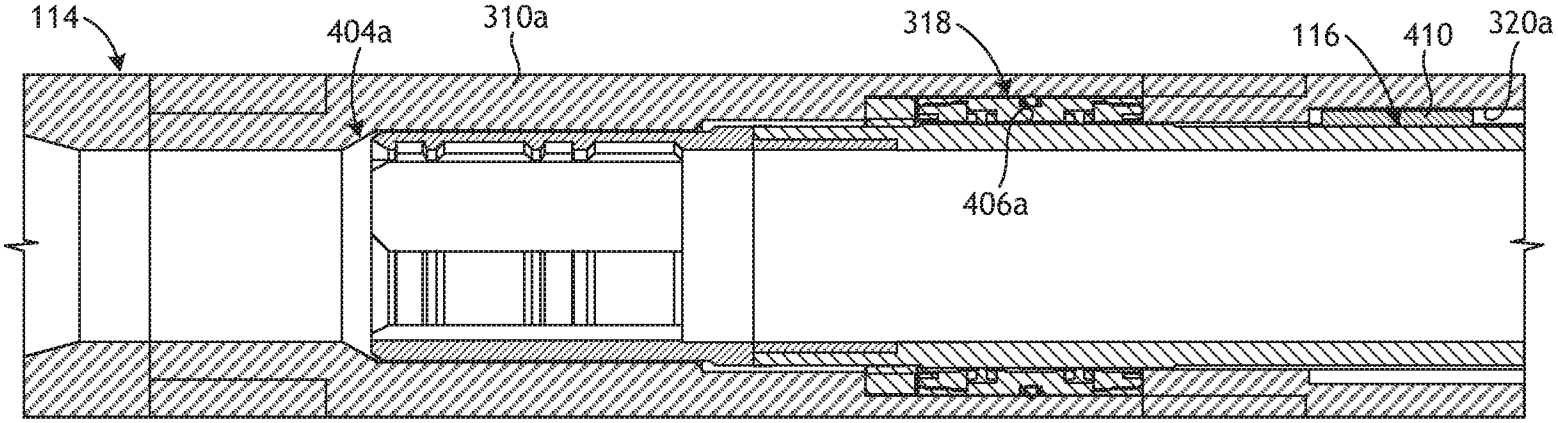
FIGS. 11A and 11B are enlarged cross-sectional side views of the isolation sleeve positioned within the completion sleeve as indicated by the dashed boxes provided in FIG. 10.
Figure 11B:
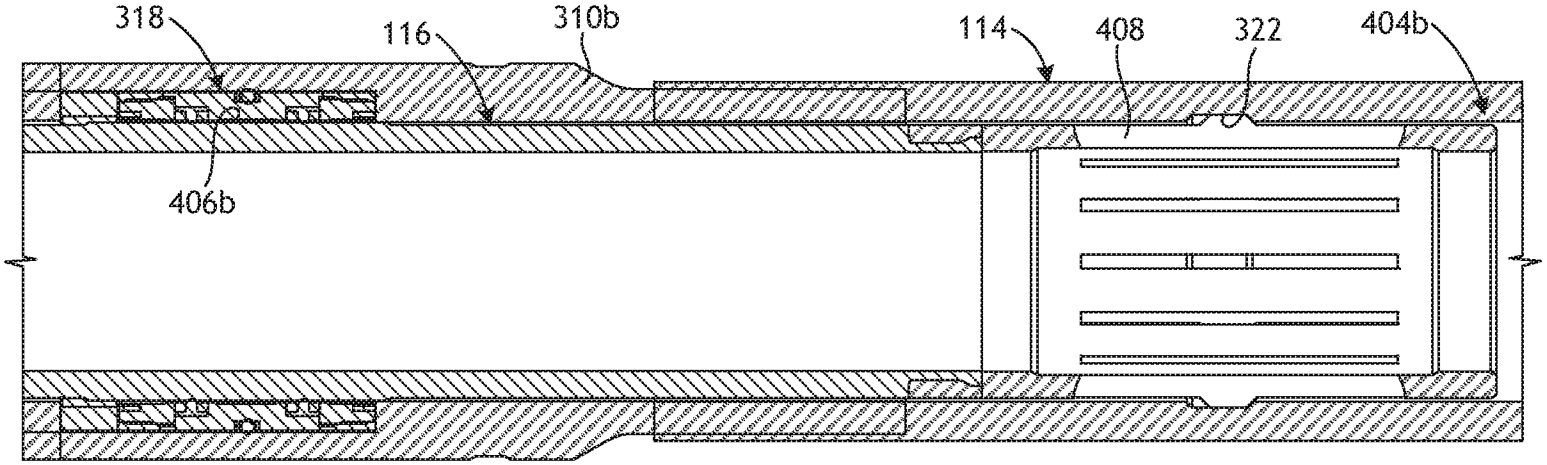

FIGS. 11A and 11B are enlarged cross-sectional side views of the isolation sleeve 116 positioned within the completion window assembly 114 as indicated by the dashed boxes provided in FIG. 10. More specifically, FIG. 11A shows the uphole end 404*a* of the isolation sleeve 116 and FIG. 11B shows the downhole end 404*b* of isolation sleeve 116. In FIG. 11A, the seal elements 318 of the upper seal housing 310*a* are sealingly engaged against the upper seal surface 406*a* of the isolation sleeve 116. In FIG. 11B, the seal elements 318 of the lower seal housing 310*b* are sealingly engaged against the lower seal surface 406*b* of the isolation sleeve 116. The isolation sleeve 116 is depicted in the close position and thereby provides the pressure integrity required to isolate the lateral wellbore 104 (FIG. 10) from the interior of the completion window assembly 114 via the window 124 (FIG. 10).

In FIG. 11A, the sleeve alignment key 410 of the isolation sleeve 116 is shown as mated (extended) within the upper slot 320*a* defined in the completion sleeve 11. As discussed above, mating the sleeve alignment key 410 with the upper slot 320*a* helps maintain the isolation sleeve 116 in a predetermined angular orientation, which may be critical in properly aligning the whipstock 204 (FIG. 7) to a desired angular orientation. In FIG. 11B, the engagement device 408 is depicted as being received in the upper coupling 322, which releasably secures the isolation sleeve 116 in the closed position.

Figure 12:
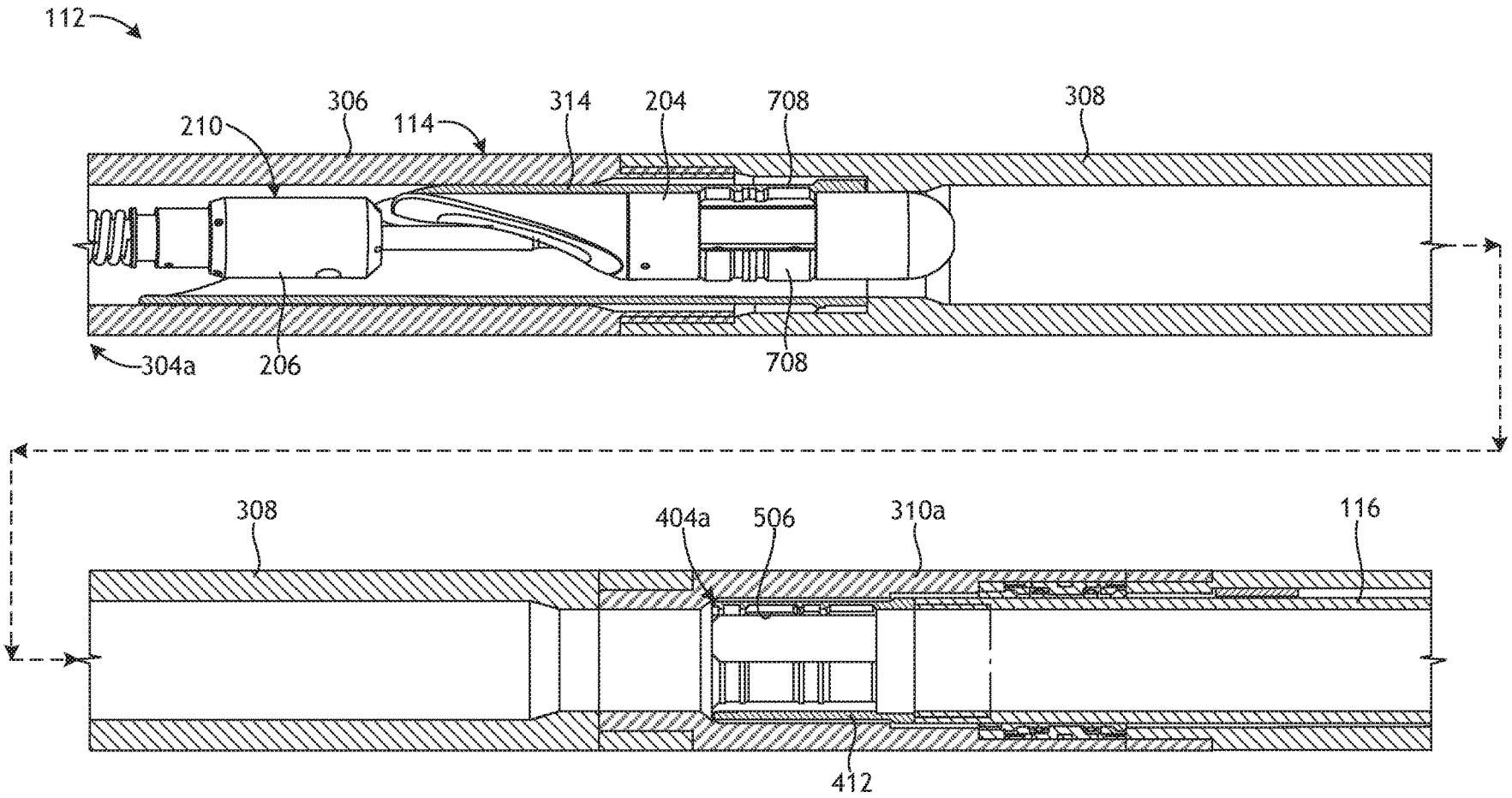
FIG. 12 is an enlarged cross-sectional side view of a portion of the reentry window assembly of FIG. 10.

FIG. 12 is an enlarged cross-sectional side view of the reentry window assembly 112 of FIG. 10. More particularly, FIG. 12 shows the uphole end 304*a* of the completion window assembly 114, the muleshoe housing 306, the spacer tube 308, the upper seal housing 310*a*, and the uphole end 404*a* of the isolation sleeve 116 positioned within the completion window assembly 114. When access into the lateral wellbore 104 (FIG. 10) is desired, the isolation sleeve 116 must be shifted from the closed position to the open position. To accomplish this, the whipstock assembly 210 is run downhole on a conveyance (e.g., coiled tubing) to locate and extend into the completion window assembly 114. As illustrated, the whipstock 204 and the running tool 206 have entered the completion window assembly 114 at the muleshoe housing 306. It is noted that the whipstock 204 may not be properly oriented at this time for accurately deflecting downhole tools out of the completion window assembly 114. The whipstock assembly 210 is advanced through the completion window assembly 114 to allow the latch key(s) 708 to eventually locate and engage the inner profile 506 of the sleeve coupling 412. While passing through portions of the completion window assembly 114 that exhibit reduced inner diameters, such as the muleshoe 314, the spring-loaded latch key(s) 708 may be configured to radially retract (compress) to allow the whipstock assembly 210 to advance without obstruction.

Figure 13:
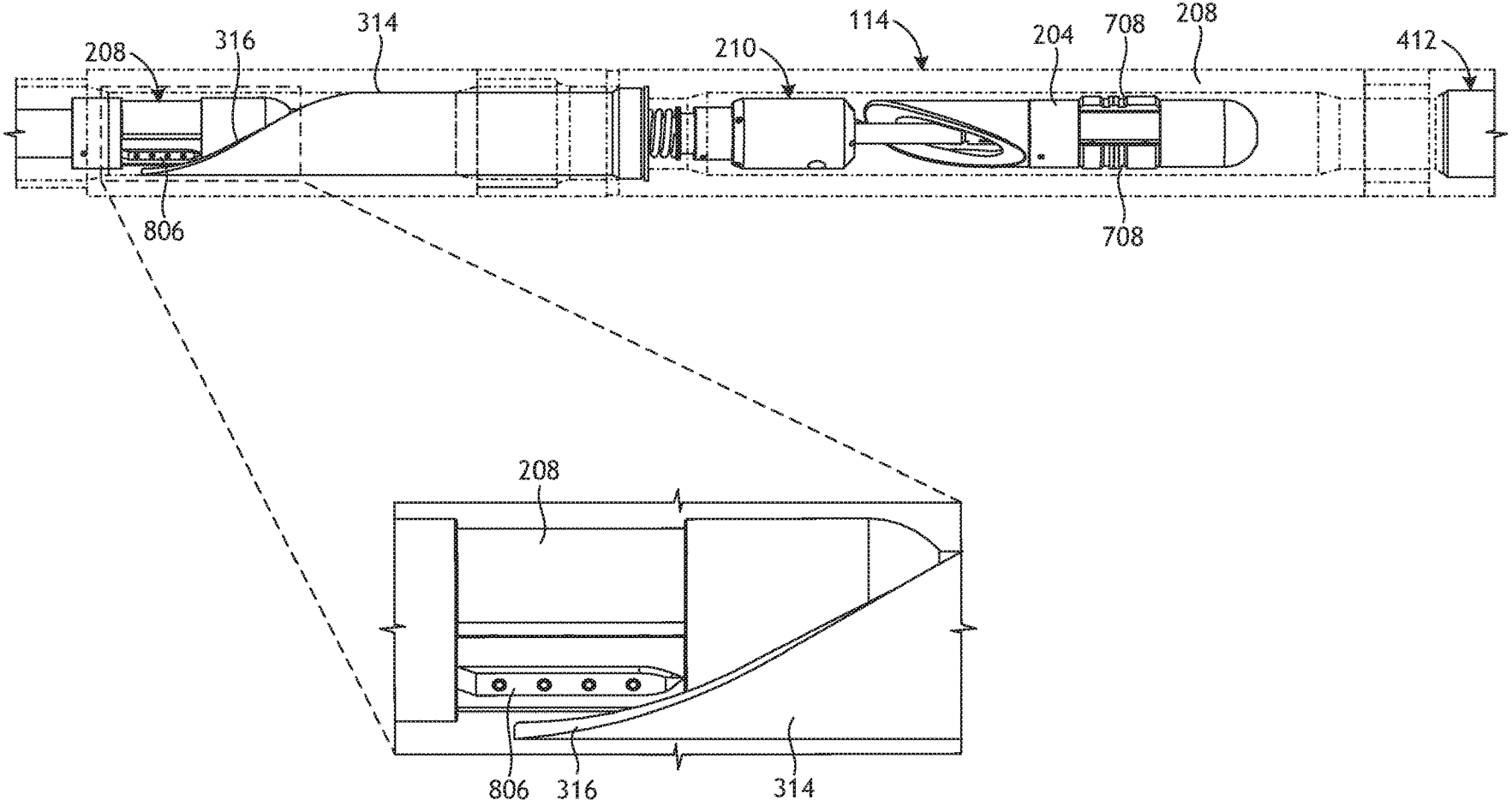
FIG. 13 is an enlarged side view of a portion of the reentry window assembly of FIG. 10.

FIG. 13 is an enlarged side view of a portion of the reentry window assembly 112 of FIG. 10 and shows the whipstock assembly 210 as having advanced further within the completion window assembly 114. For convenience in depicting the process, the completion window assembly 114 is shown in phantom (i.e. dashed linetype) as the whipstock assembly 210 advances axially therein. As illustrated, the whipstock assembly 210 has advanced to a point where the alignment key 806 of the aligning tool 208 has engaged the muleshoe profile 316 of the muleshoe 314. It is at this point when proper angular orientation of the whipstock 204 commences before the whipstock 204 ultimately mates with the sleeve coupling 412. More specifically, as the whipstock assembly 210 continues axial movement in the downhole direction, the alignment key 806 rides against the muleshoe profile 316, which causes the aligning tool 208 to rotate. Since the aligning tool 208 is operatively coupled to the running tool 206 and the whipstock 204, angular rotation of the aligning tool 208 correspondingly rotates the running tool 206 and the whipstock 204.

In some embodiments, as illustrated, the whipstock 204 will be angularly rotated while residing within the spacer tube 308. This may prove advantageous since the spacer tube 308 may exhibit a larger inner diameter that will accommodate the latch key(s) 708 in their fully expanded state. As a result, this will allow the alignment tool 208 to orient itself without having to overcome the friction that the latch key(s) 708 would generate as engaged against the inner wall of a smaller diameter tubing or structure.

Figure 14:
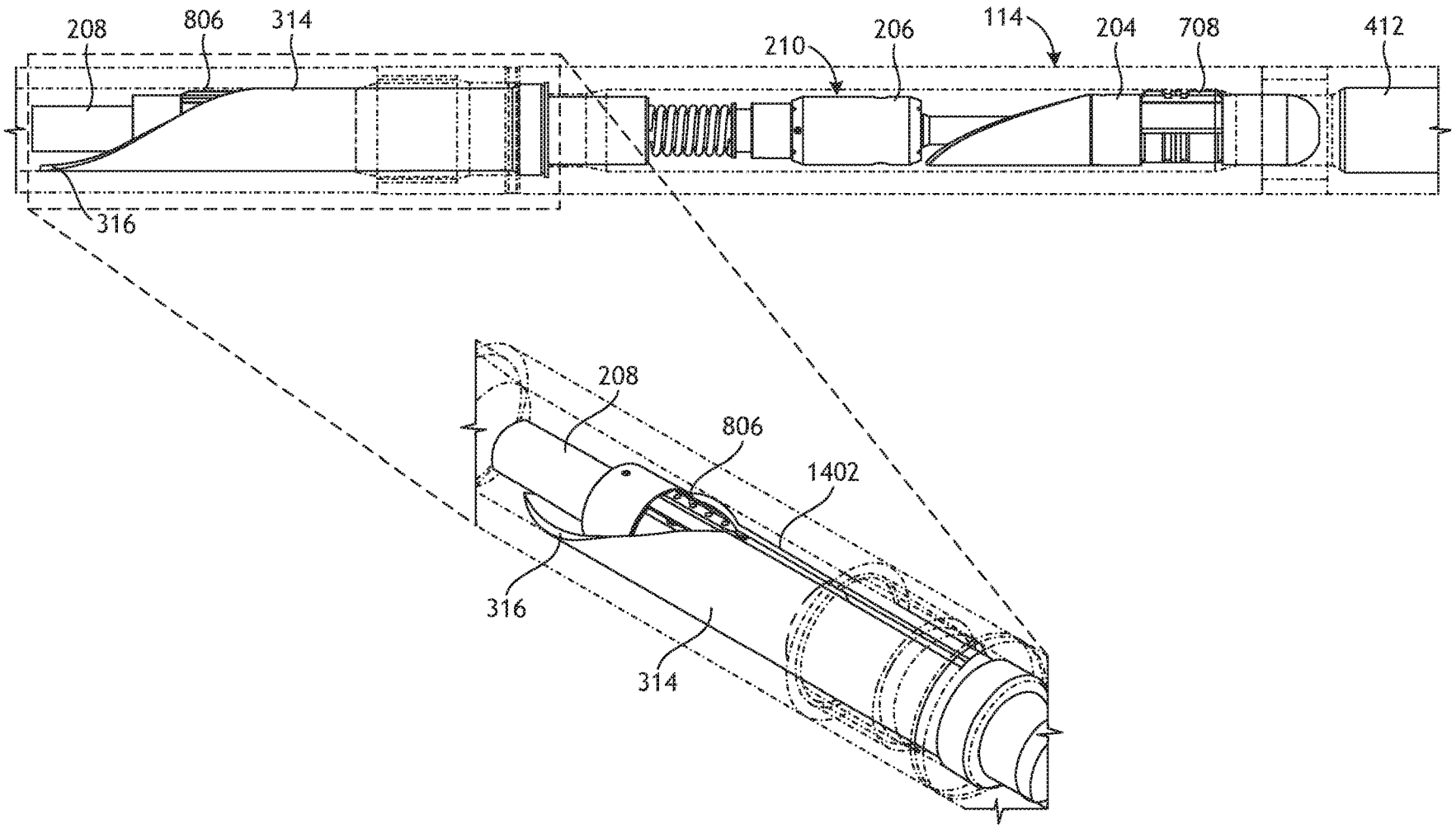
FIG. 14 is an enlarged side view of another portion of the reentry window assembly of FIG. 10.

FIG. 14 is an enlarged side view of a portion of the reentry window assembly 112 of FIG. 10 and shows the whipstock assembly 210 after having advanced even further within the completion window assembly 114. Again, for convenience in depicting the process, the completion window assembly 114 is shown in phantom (i.e., dashed linetype) as the whipstock assembly 210 advances axially therein. As the whipstock assembly 210 continues axial movement in the downhole direction within the completion window assembly 114, the alignment key 806 rides against the muleshoe profile 316 and thereby rotates the whipstock assembly 210 to the proper orientation. In some embodiments, as shown in the enlarged view of FIG. 14, the alignment key 806 may eventually locate and extend into an axial slot 1402 that transitions from the muleshoe profile and is defined axially along all or a portion of the muleshoe 314. The axial slot 1402 may be sized to receive the alignment key 806 and help maintain the angular orientation of the whipstock assembly 210 as the whipstock assembly 210 advances within the completion window assembly 114 to eventually couple the whipstock 204 to the sleeve coupling 412.

Rotating the whipstock assembly 210 to the proper orientation and maintaining the whipstock 204 in the desired orientation with the alignment key 806 may help the whipstock 204 properly locate and couple to the sleeve coupling 412. More specifically, as discussed above, the latch key(s) 708 and the inner profile 506 (FIG. 12) of the sleeve coupling 412 have unique matching profiles that when engaged in the right orientation will match and lock radially and axially. If the whipstock 204 is not properly oriented before entering the sleeve coupling 412, however, the latch key(s) 708 may inadvertently pass through the inner profile 506 and the whipstock assembly 210 may bypass the predetermined area of installation altogether.

Figure 15:
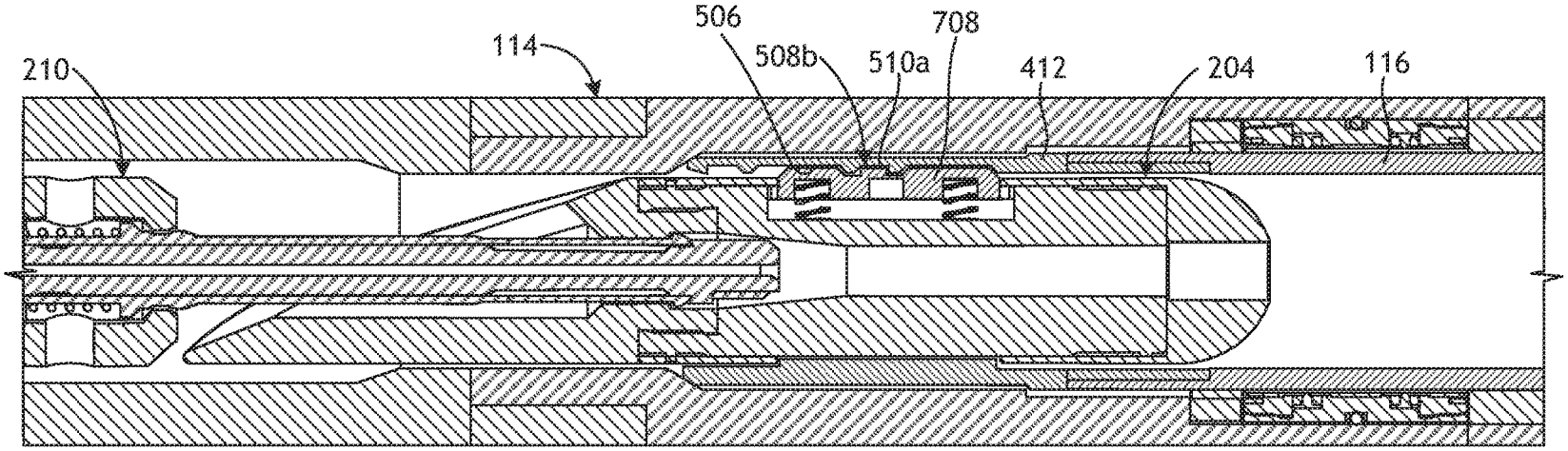
FIG. 15 is an enlarged cross-sectional side view of a portion of the reentry window assembly of FIG. 10.

FIG. 15 is an enlarged cross-sectional side view of a portion of the reentry window assembly 112 of FIG. 10 and shows the whipstock 204 coupled to the sleeve coupling 412. Once the whipstock 204 is angularly aligned and able to hold its angular orientation, as discussed above, the whipstock assembly 210 may advance further within the completion window assembly 114 until the latch key(s) 708 are received within the sleeve coupling 412. The latch key(s) 708 will latch into the inner profile 506 of the sleeve coupling 412 to radially and axially fix the whipstock 204 to the isolation sleeve 116. The latch key(s) 708 are designed to only mate with a matching inner profile 506 and will bypass mismatched inner profiles. As will be appreciated, this may prove advantageous in allowing a well operator to bypass other reentry window assemblies that may be installed downhole and ensure that the whipstock assembly 210 will only be secured to a desired completion window assembly 114 at a desired downhole location.

Once the whipstock 204 is properly coupled to the isolation sleeve 116 at the sleeve coupling 412, the whipstock assembly 210 may then be able to transmit the axial force required to shift the isolation sleeve 116 to the open position. More particularly, the latch key(s) 708 are engaged with the lower inner profile 508*b* of the inner profile 506, which provides the uphole-facing shoulder 510*a*. With the latch key(s) 708 engaged against the uphole-facing shoulder 510*a*, axial loads assumed by the whipstock assembly 210 will be transmitted to the isolation sleeve 116 and urge the isolation sleeve 116 downhole to the open position. In some embodiments, to shift the isolation sleeve 116 to the open position, a jarring tool (not shown) coupled to the whipstock assembly 210 may be actuated to provide an impact force required to disengage the engagement device 408 from the upper coupling 322 and start shifting the isolation sleeve 116 toward the open position.

In some embodiments, there may be an indication confirming that the whipstock 204 has successfully mated with the sleeve coupling 412. The confirming indication, for example, may be in the form of a "no-go" axial force that can be sensed at the well surface location. More specifically, axial loads applied to the isolation sleeve 116 from the whipstock assembly 210 when the whipstock assembly 116 is in the closed position will be resisted by the engagement device 408 (FIG. 11B) of the isolation sleeve 116 as coupled to the upper coupling 322 (FIG. 11B). The "no-go" indication force results from having the engagement device 408 mated with the upper coupling 322, and once the "no-go" axial force is sensed, it will confirm that the whipstock 204 is successfully coupled to the isolation sleeve 116 and ready to be shifted to the open position.

While the illustrated embodiment shows the whipstock assembly 210 being used to provide the axial force required to shift the isolation sleeve 116 to the open position, in other embodiments, the isolation sleeve 116 may be shifted to the open position prior to introducing the whipstock assembly 210 downhole. In such embodiments, a shifting tool or similar device may be used to locate and mate with the sleeve coupling 412 and subsequently provide an axial loading that shifts the isolation sleeve 116 to the open position, without departing from the scope of the disclosure. Moreover, in such embodiments, a jarring tool may be included in or otherwise operatively coupled to the shifting tool to provide the necessary axial loading to shift the isolation sleeve 116 toward the open position.

Figure 16:
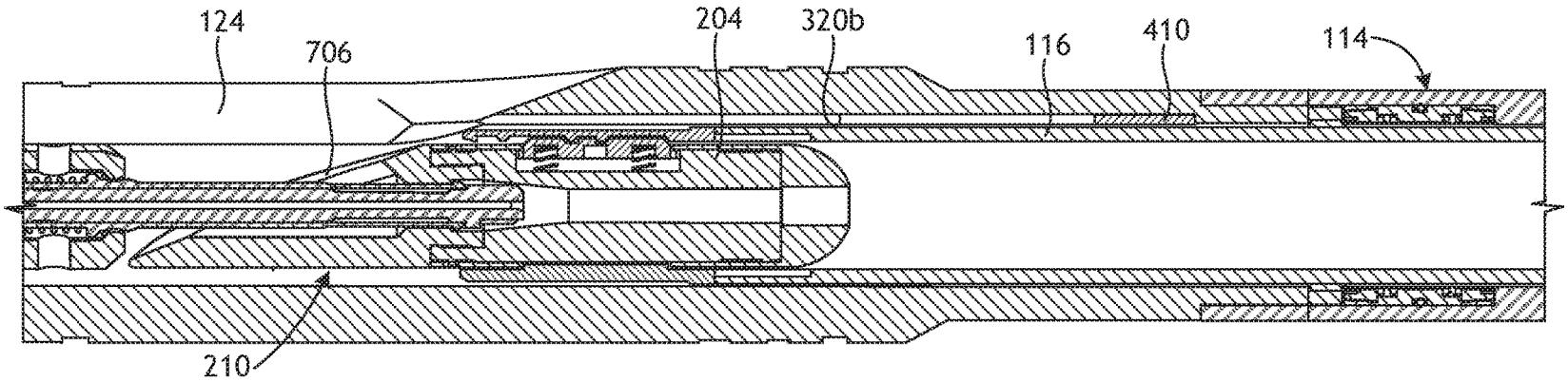
FIG. 16 is an enlarged cross-sectional side view of another portion of the reentry window assembly of FIG. 10.

FIG. 16 is an enlarged cross-sectional side view of a portion of the reentry window assembly 112 of FIG. 10 and shows the whipstock assembly 210 and the isolation sleeve 116 as having advanced within the completion window assembly 114. As the isolation sleeve 116 moves from the closed position to the open position, the sleeve alignment key 410 may extend radially through the window 124 and thereby help maintain the whipstock assembly 210 in the proper azimuthal orientation. The window 124, therefore, may act as guide as the isolation sleeve 116 moves downhole (i.e., to the right in FIG. 16) and the alignment key 410 eventually locates and engages the lower slot 320*b* defined in the completion window assembly 114. Interacting the alignment key 410 with the lower slot 320*b* allows the isolation sleeve 116 to radially fix and fully orient the whipstock assembly 210 to the proper orientation, which includes the whipstock face 706 of the whipstock 204 being angularly oriented toward the window 124.

Figure 17:
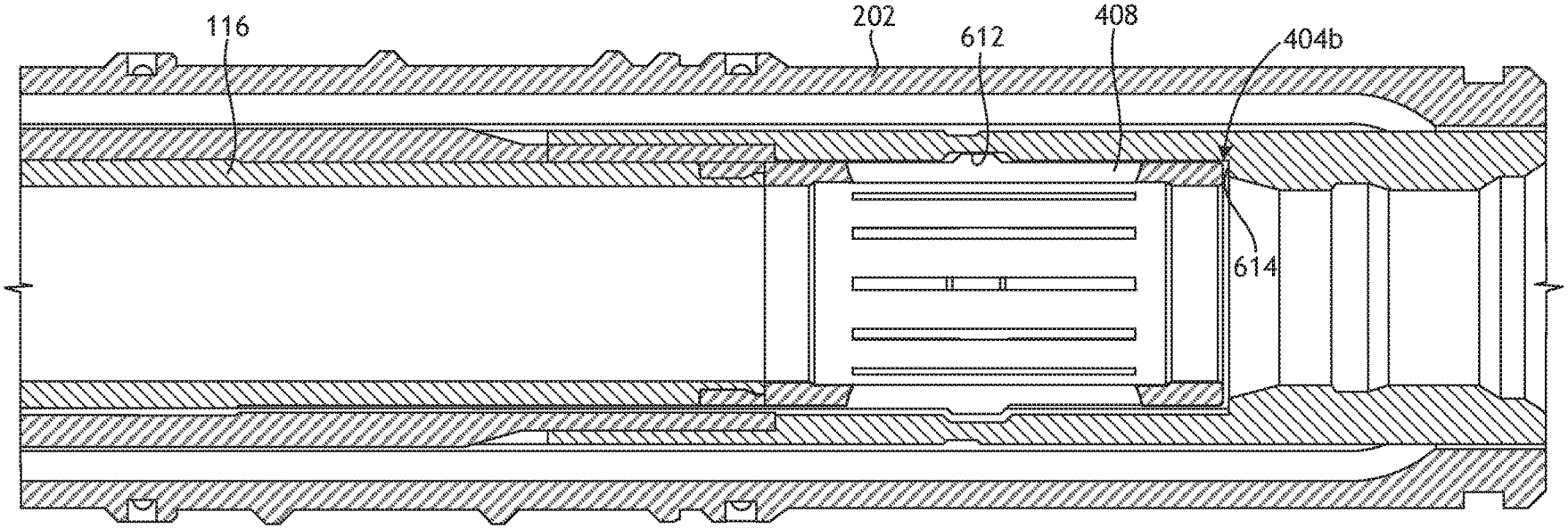
FIG. 17 is an enlarged cross-sectional side view of another portion of the reentry window assembly of FIG. 10.

FIG. 17 is an enlarged cross-sectional side view of a portion of the reentry window assembly 112 of FIG. 10 and shows the downhole end 404*b* of the isolation sleeve 116 when the isolation sleeve 116 is moved to the open position. More particularly, when moved to the open position, the downhole end 404*b* of the isolation sleeve 116 will be located within the latch assembly 202 and the engagement device 408 may be coupled to the lower coupling 612 defined on the inner radial surface of the latch assembly 202. With the engagement device 408 mated with the lower coupling 612, the isolation sleeve 116 will be axially fixed in the open position.

In some embodiments, the isolation sleeve 116 may move toward the open position until the downhole end 404*b* engages the no-go shoulder 614 defined on the inner radial surface of the latch assembly 202. Engaging the no-go shoulder 614 may be sensed at the well surface location and provide positive indication that the isolation sleeve 116 has successfully moved to the open position. At this point, the isolation sleeve 116 is fully constrained within the completion window assembly 114 and the whipstock 204 (FIG. 16) is axially and angularly oriented to deflect downhole tools into the lateral wellbore 104 (FIG. 10).

Figure 18A:
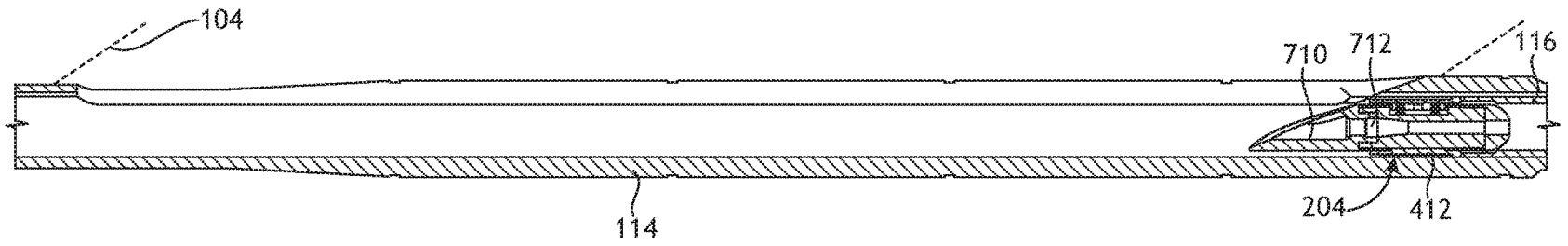
FIGS. 18A-18C are progressive cross-sectional side views of the completion sleeve depicting a downhole tool being deflected into the lateral wellbore.
Figure 18B:
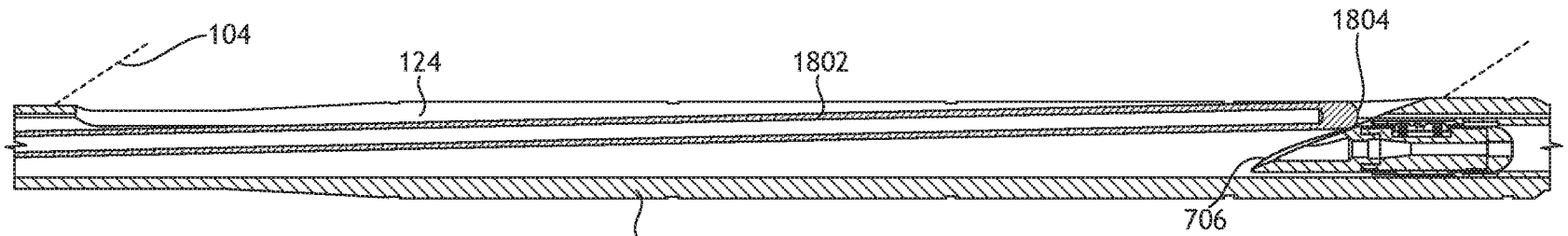
Figure 18C:
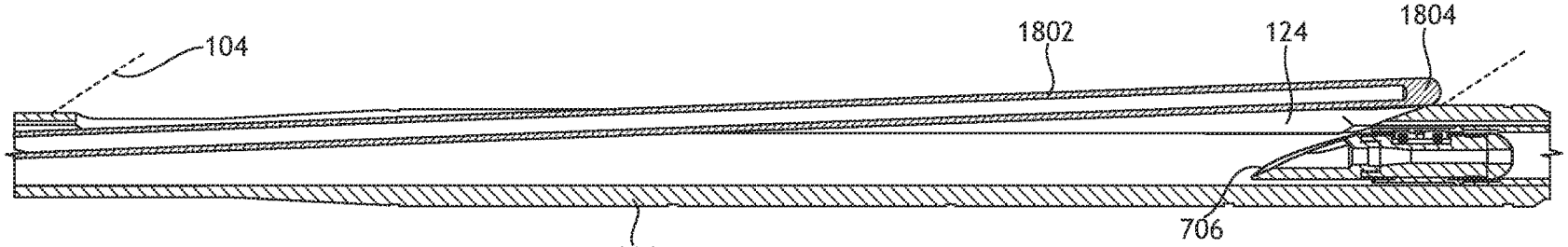

FIGS. 18A-18C are progressive cross-sectional side views of the completion window assembly 114 depicting a downhole tool 1802 being deflected into the lateral wellbore 104. In FIG. 18A, the whipstock 204 is shown secured within the completion window assembly 114 as coupled to the isolation sleeve 116 at the sleeve coupling 412. The running tool 206 and the aligning tool 208 (FIGS. 12-16) have been detached from the whipstock 204 by actuating the running tool 206 with applied pressure from surface, as described herein with reference to FIGS. 9A-9C. Once the running tool 206 has detached from the inner profile 712 defined within the central passage 710 of the whipstock 204, the running tool 206 may be drawn out of the central passage 710 and retrieved (retracted) back to the well surface location.

In FIG. 18B, the downhole tool 1802 is depicted as extended into the completion window assembly 114 and engaging the whipstock 204. The downhole tool 1802 may be conveyed into the completion window assembly 114 on a variety of conveyances, such as coiled tubing, and may include a bullnose 1804 configured to engage and ride up the whipstock face 706. Riding up the whipstock face 706 deflects the bullnose 1804 through the window 124 and out of the completion window assembly 114.

In FIG. 18C, the downhole tool 1802 has advanced sufficiently within the completion window assembly 114 and traversed the whipstock face 706 such that it has deflected out of the completion window assembly 114 via the window 124. Once extended out the window 124, the downhole tool 1802 will be able to advance into the lateral wellbore 104 to undertake a variety of known downhole operations.

Figure 19:
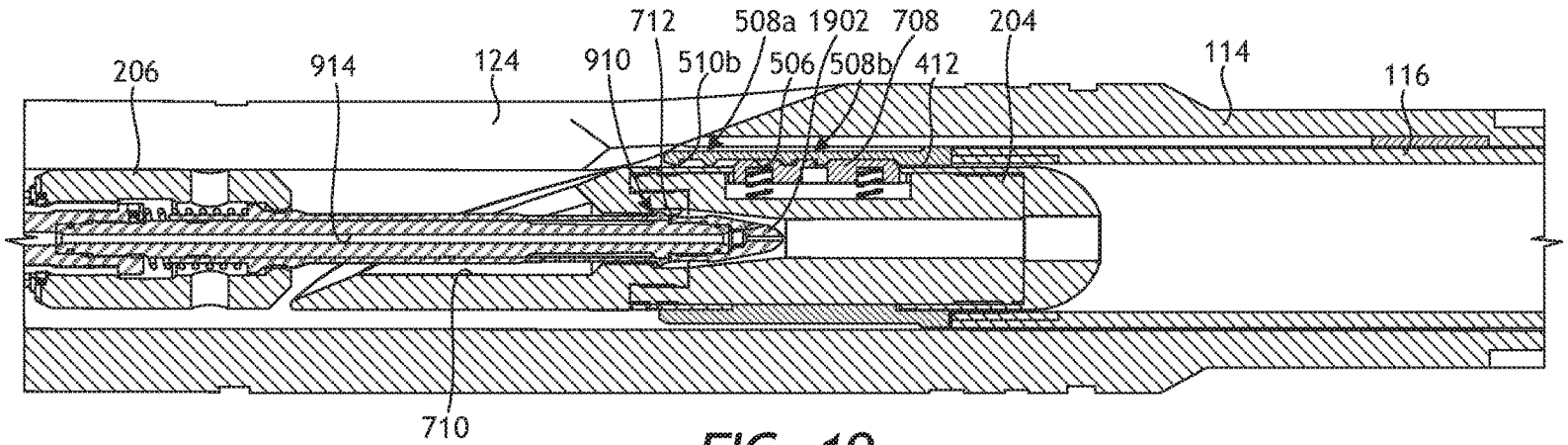
FIG. 19 is an enlarged cross-sectional side view of a portion of the reentry window assembly of FIG. 10 and shows the whipstock engaged with the isolation sleeve in the open position.

FIG. 19 is an enlarged cross-sectional side view of a portion of the reentry window assembly 112 of FIG. 10 and shows the whipstock 204 engaged with the sleeve coupling 412 and the isolation sleeve 116 in the open position. When it is desired to once again isolate the lateral wellbore 104 (FIGS. 18A-18C), the isolation sleeve 116 must be moved back to the closed position and thereby occlude and seal the window 124 once again. To accomplish this, the running tool 206 may again be conveyed downhole and enter the completion window assembly 114 to locate and mate with the whipstock 204. Accordingly, the running tool 206 may alternately referred to as a "retrieving" tool.

As illustrated, the retrieving tool 206 may include a tapered bullnose 1902 that enables the retrieving tool 206 to stab or "sting" into the central passage 710 of the whipstock 204. Upon entering the central passage 710, the retrieving tool 206 may be actuated to allow the engagement device 910 to mate with or otherwise be coupled to the inner profile 712. As described herein with reference to FIGS. 9A-9C, actuation of the retrieving tool 206 may be accomplished by pressurizing the central passageway 914.

Once the retrieving tool 206 is properly coupled to the whipstock 204 at the inner profile 712, the retrieving tool 206 may be pulled back in the uphole direction (i.e., to the left in FIG. 19) to start moving the isolation sleeve 116 toward the closed position. Pulling on the retrieving tool 206 in the uphole direction, however, will be resisted by the engagement device 408 (FIG. 17) as coupled to the lower coupling 612 (FIG. 17). The axial resistance provided by the engagement device 408 allows the latch key(s) 708 to snap out of engagement with the lower inner profile 508*b* of the inner profile 506 and mate with the upper inner profile 508*a*, which includes the downhole-facing shoulder 510*b*. With the latch key(s) 708 mated with the upper inner profile 508*a*, an uphole axial load may be applied to the retrieving tool 206, which will be transmitted to the isolation sleeve 116 to overcome the mating force of the engagement device 408 as engaged with the lower coupling 612. Once the engagement device 408 is freed from the lower coupling 612, the retrieving tool 206 may then freely move the isolation sleeve 116 to the closed position by pulling in the uphole direction (i.e., to the left in FIG. 19).

Figure 20:
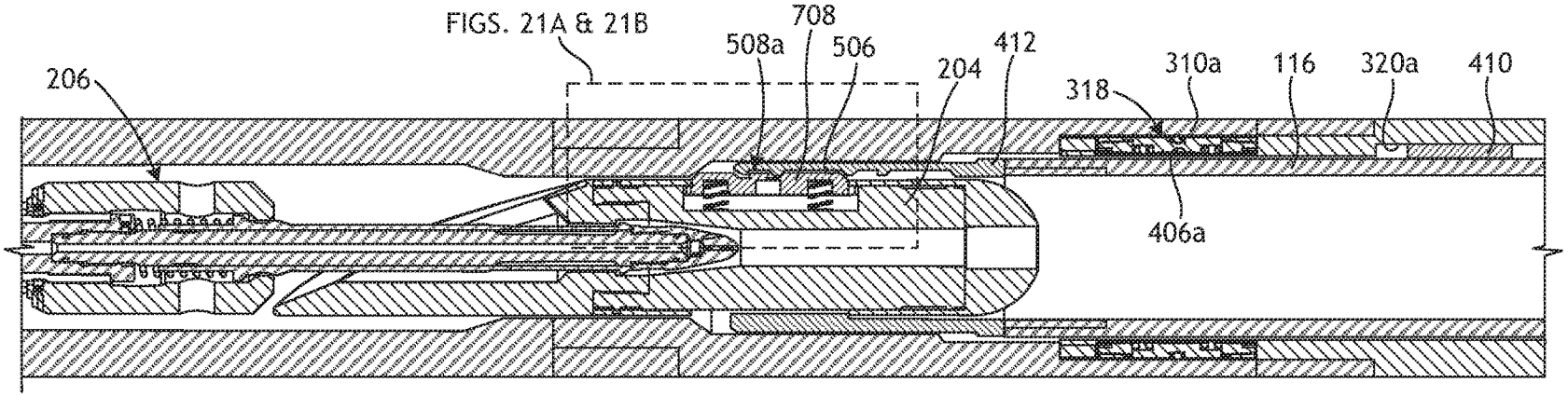
FIG. 20 is an enlarged cross-sectional side view of a portion of the reentry window assembly of FIG. 10 and shows the isolation sleeve moved back to the closed position.

FIG. 20 is an enlarged cross-sectional side view of a portion of the reentry window assembly 112 of FIG. 10 and shows the isolation sleeve 116 moved back to the closed position using the retrieving tool 206. As the isolation sleeve 116 moves to the closed position, the sleeve alignment key 410 helps to maintain the isolation sleeve 116 oriented as it traverses the window 124 (FIGS. 18A-18C) and eventually is reintroduced into the upper slot 320*a*. In the closed position, the engagement device 408 (FIG. 11B) is again received within the upper coupling 322 (FIG. 11B) to axially fix the isolation sleeve 116. Moreover, in the closed position, the seal elements 318 (FIG. 3) of the upper and lower seal housings 310*a,b* (FIG. 3) will once again sealingly engage the upper and lower seal surfaces 406*a,b* (FIG. 4) of the isolation sleeve 116. This will ensure the pressure integrity required in the well system 100 (FIG. 1) at the closed position.

With the isolation sleeve 116 in the closed position, the whipstock 204 may then be disengaged from the sleeve coupling 412 and retrieved to surface as coupled to the retrieving tool 206. To accomplish this, however, the latch key(s) 708 must disengage from the inner profile 506 of the sleeve coupling 412.

Figure 21A:
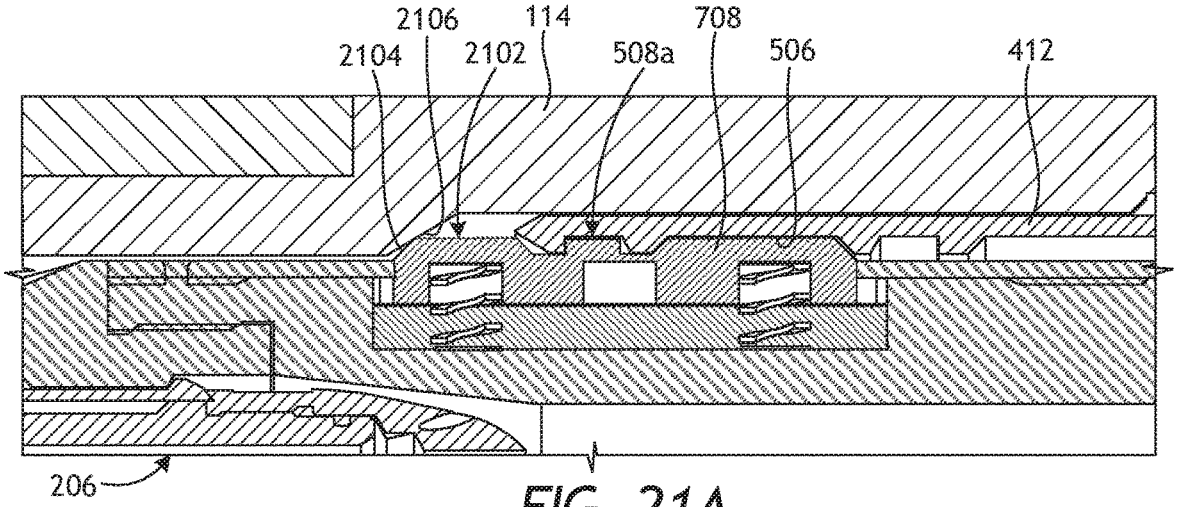
FIGS. 21A and 21B are enlarged cross-sectional side views of the latch key(s) and the inner profile of the sleeve coupling, as indicated by the dashed box of FIG. 20.
Figure 21B:
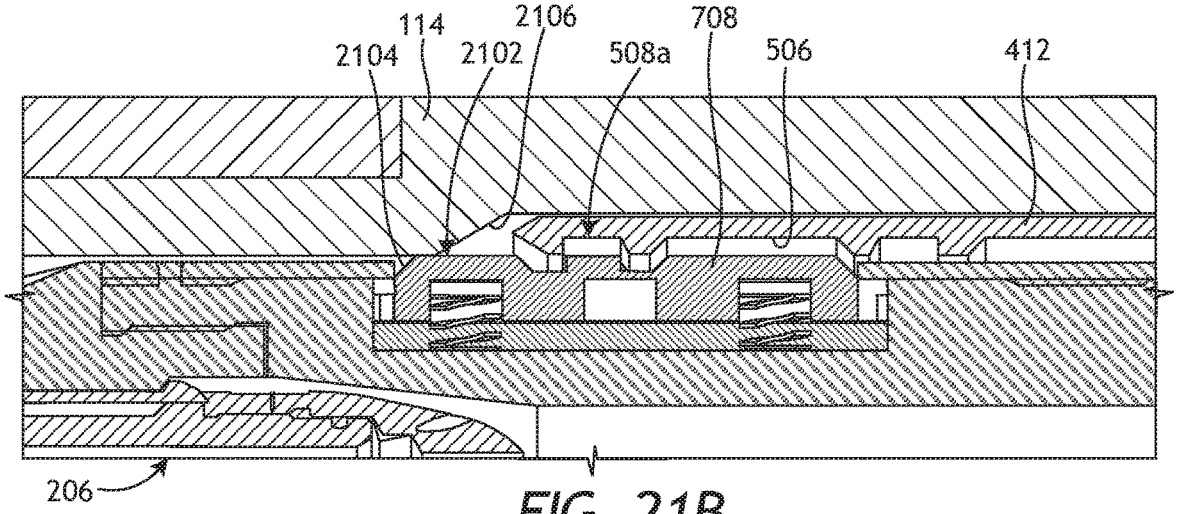

FIGS. 21A and 21B are enlarged cross-sectional side views of the latch key(s) 708 and the inner profile 506 of the sleeve coupling 412, as indicated by the dashed box of FIG. 20. With the latch key(s) 708 mated with the upper inner profile 508*a* of the inner profile 506 of the sleeve coupling 412, an upper section 2102 of the latch key(s) 708 becomes exposed and otherwise extends out of the uphole end of the sleeve coupling 412. This may prove advantageous in helping the whipstock 204 disengage from the sleeve coupling 412.

More specifically, the upper section 2102 of the latch key(s) 708 may provide or otherwise define an angled surface 2104 and the inner wall of the completion window assembly 114 may provide or otherwise define an opposing angled surface 2106. As the retrieving tool 206 pulls axially on the whipstock 204 in the uphole direction (i.e., to the left in FIGS. 21A and 21B), the angled surface 2104 of the latch key(s) 708 will engage the angled surface 2106 of the completion window assembly 114, as shown in FIG. 21A, and urge the spring-loaded latch key(s) 708 to radially contract as they slide against the angled surface 2106. As they radially contract, the latch key(s) 708 disengage from the inner profile 506 and free the whipstock 204 from the sleeve coupling 412, as shown in FIG. 21B. With the whipstock 204 free from the sleeve coupling 412, the retrieving tool 206 may retrieve the whipstock 204 back to the surface location.

Embodiments disclosed herein include:

A. A well system that includes a parent wellbore lined with casing that defines a casing exit, a lateral wellbore extending from the casing exit, a reentry window assembly installed within the parent wellbore and including a completion window assembly having a window aligned with the casing exit and providing an upper coupling, a muleshoe, and upper and lower slots provided on opposing axial ends of the window, an isolation sleeve positioned within the completion window assembly and including a sleeve alignment key, a sleeve coupling, and an engagement device, and a whipstock assembly including a whipstock matable with the sleeve coupling and an aligning tool operatively coupled to the whipstock and engageable with the muleshoe to angularly orient a whipstock face to the window, wherein the isolation sleeve is movable between a first position, where the engagement device engages the upper coupling and the isolation sleeve occludes the window, and a second position, where the isolation sleeve engages a lower coupling and the window is exposed, and wherein the sleeve alignment key interacts with the upper and lower slots to maintain the isolation sleeve in a predetermined angular orientation while moving between the first and second positions.

B. A method that includes advancing a whipstock assembly into a parent wellbore lined with casing that defines a casing exit and has a lateral wellbore extending from the casing exit, the whipstock assembly including a whipstock and an aligning tool operatively coupled to the whipstock, extending the whipstock assembly into a completion window assembly that provides a muleshoe and has a window aligned with the casing exit, engaging the aligning tool on the muleshoe and thereby angularly orienting a whipstock face of the whipstock to the window, coupling the whipstock to a sleeve coupling provided on an isolation sleeve positioned within the completion window assembly, and deflecting a downhole tool off the whipstock face and through the window to access the lateral wellbore.

C. A reentry window assembly that includes a completion window assembly having a window and providing an upper coupling, a muleshoe, and upper and lower slots provided on opposing axial ends of the window, an isolation sleeve positioned within the completion window assembly and including a sleeve alignment key, a sleeve coupling, and an engagement device, and a whipstock assembly including a whipstock matable with the sleeve coupling and an aligning tool operatively coupled to the whipstock and engageable with the muleshoe to angularly orient a whipstock face to the window, wherein the isolation sleeve is movable between a first position, where the engagement device engages the upper coupling and the isolation sleeve occludes the window, and a second position, where the isolation sleeve engages a lower coupling and the window is exposed, and wherein the sleeve alignment key interacts with the upper and lower slots to maintain the isolation sleeve in a predetermined angular orientation while moving between the first and second positions.

Each of embodiments A, B, and C may have one or more of the following additional elements in any combination: Element 1: wherein the aligning tool includes an alignment key engageable with a muleshoe profile defined on the muleshoe to angularly rotate the whipstock face to the predetermined angular orientation. Element 2: wherein the muleshoe profile transitions into an axial slot defined axially along the muleshoe and sized to receive the alignment key. Element 3: wherein the whipstock further includes one or more latch keys that selectively locate and engage an inner profile defined on the sleeve coupling. Element 4: wherein the reentry window assembly further includes a latch coupling operatively coupled to the completion window assembly and the lower coupling is defined on an inner surface of the latch coupling. Element 5: further comprising an interval control valve positioned in the parent wellbore uphole from the lateral wellbore to regulate fluid production from the lateral wellbore, and a communications line extended from a well surface location and communicably coupled to the interval control valve to actuate the interval control valve between open and closed configurations. Element 6: further comprising one or more downhole sensors arranged in the parent wellbore adjacent the lateral wellbore and communicably coupled to the communications line, wherein the one or more downhole sensors provide real-time measurements of downhole conditions to the well surface location and the interval control valve is actuated based on the real-time measurements of downhole conditions. Element 7: wherein the whipstock assembly further includes a running tool operatively coupled to the whipstock and the whipstock assembly moves the isolation sleeve between the first and second positions with the whipstock coupled to the sleeve coupling. Element 8: wherein the casing exit is a first casing exit, the lateral wellbore is a first lateral wellbore, and the reentry window assembly is a first reentry window assembly, the well system further comprising a second lateral wellbore extending from a second casing exit defined in the parent wellbore, a second reentry window assembly installed within the parent wellbore at the second lateral wellbore, a first interval control valve positioned in the parent wellbore uphole from the first lateral wellbore to regulate fluid production from the first lateral wellbore, a second interval control valve positioned in the parent wellbore uphole from the second lateral wellbore to regulate fluid production from the second lateral wellbore, and a communications line extended from a well surface location and communicably coupled to the first and second interval control valves to actuate the first and second interval control valves between open and closed configurations. Element 9: further comprising one or more first downhole sensors arranged within the parent wellbore adjacent the first lateral wellbore and communicably coupled to the communications line, and one or more second downhole sensors arranged within the parent wellbore adjacent the second lateral wellbore and communicably coupled to the communications line, wherein the one or more first and second downhole sensors provide real-time measurements of downhole conditions to the well surface location and the first and second interval control valves are actuated based on the real-time measurements of downhole conditions. Element 10: wherein the isolation sleeve in the first position seals the window and thereby isolates fluids in the parent wellbore from fluids in the lateral wellbore.

Element 11: further comprising sealing the window with the isolation sleeve and thereby isolating fluids in the parent wellbore from fluids in the lateral wellbore. Element 12: wherein coupling the whipstock to the sleeve coupling further comprises moving the isolation sleeve from a first position, where an engagement device provided on the isolation sleeve engages the upper coupling and the isolation sleeve occludes the window, and to a second position, where the isolation sleeve engages a lower coupling and the window is exposed. Element 13: wherein the completion window assembly further includes upper and lower slots provided on opposing axial ends of the window and the isolation sleeve further provides an alignment key, the method further comprising interacting the sleeve alignment key with the upper and lower slots and thereby maintaining the isolation sleeve in a predetermined angular orientation while moving between the first and second positions. Element 14: wherein upper and lower couplings are provided on an inner surface of the completion window assembly adjacent opposing axial ends of the window, the method further comprising securing the isolation sleeve in the first position by mating an engagement device of the isolation sleeve with the upper coupling, and securing the isolation sleeve in the second position by mating the engagement device with the lower coupling. Element 15: wherein advancing the whipstock assembly into the parent wellbore is preceded by moving the isolation sleeve from a first position, where an engagement device provided on the isolation sleeve engages the upper coupling and the isolation sleeve occludes the window, and to a second position, where the isolation sleeve engages a lower coupling and the window is exposed. Element 16: wherein engaging the aligning tool on the muleshoe comprises slidingly engaging an alignment key of the aligning tool on a muleshoe profile defined on the muleshoe and thereby angularly orienting the whipstock face to the window. Element 17: wherein the casing exit is a first casing exit, the lateral wellbore is a first lateral wellbore, and the reentry window assembly is a first reentry window assembly, the method further comprising regulating fluid production from the first lateral wellbore with a first interval control valve positioned in the parent wellbore uphole from the first lateral wellbore, regulating fluid production from a second lateral wellbore extending from a second casing exit defined in the parent wellbore with a second interval control valve positioned in the parent wellbore uphole from the second lateral wellbore, wherein a second reentry window assembly is installed within the parent wellbore at the second lateral wellbore, and actuating the first and second interval control valves between open and closed configurations using control signals provided through a communications line extended from a well surface location and communicably coupled to the first and second interval control valves. Element 18: further comprising providing downhole condition measurements to the well surface location with one or more first downhole sensors arranged within the parent wellbore adjacent the first lateral wellbore and communicably coupled to the communications line, providing downhole condition measurements to the well surface location with one or more second downhole sensors arranged within the parent wellbore adjacent the second lateral wellbore and communicably coupled to the communications line, and actuating the first and second interval control valves based on the downhole condition measurements. Element 19: wherein the isolation sleeve is a first isolation sleeve, the sleeve coupling is a first sleeve coupling, and the second reentry window assembly includes a second isolation sleeve having a second sleeve coupling, the method further comprising selectively locating and engaging an inner profile of one of the first and second sleeve couplings with one or more latch keys provided on the whipstock. Element 20: further comprising conveying a retrieving tool into the primary wellbore, coupling the retrieving tool to the whipstock assembly, and moving the isolation sleeve back to the first position with the retrieving tool.

By way of non-limiting example, exemplary combinations applicable to A, B, and C include: Element 1 with Element 2; Element 5 with Element 6; Element 8 with Element 9; Element 12 with Element 13; Element 12 with Element 14; Element 17 with Element 18; and Element 17 with Element 19.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A well system, comprising:

a casing with a casing exit;

a reentry window assembly installed within the casing exit and including:

a completion window assembly having a window aligned with the casing exit and providing an upper coupling, a muleshoe, and upper and lower slots provided on opposing axial ends of the window;

an isolation sleeve positioned within the completion window assembly and including a sleeve alignment key, a sleeve coupling, and an engagement device, wherein the sleeve alignment key is configured to angularly orient the isolation sleeve within the window in a closed position or an open position; and a whipstock assembly including a whipstock matable with the sleeve coupling and an aligning tool operatively coupled to the whipstock and engageable with the muleshoe to angularly orient a whipstock face to the window, wherein the isolation sleeve is movable between a first position, where the engagement device engages the upper coupling and the isolation sleeve occludes the window, and a second position, where the isolation sleeve engages a lower coupling and the window is exposed, wherein the sleeve alignment key interacts with the upper and lower slots to maintain the isolation sleeve in a predetermined angular orientation while moving between the first and second positions, and wherein the upper slot and the lower slot are separated by the window.

2. The well system of claim 1, wherein the aligning tool includes an alignment key engageable with a muleshoe profile defined on the muleshoe to angularly rotate the whipstock face to the predetermined angular orientation.

3. The well system of claim 2, wherein the muleshoe profile transitions into an axial slot defined axially along the muleshoe and sized to receive the alignment key.

4. The well system of claim 1, wherein the whipstock further includes one or more latch keys that selectively locate and engage an inner profile defined on the sleeve coupling.

5. The well system of claim 1, wherein the reentry window assembly further includes a latch coupling operatively coupled to the completion window assembly and the lower coupling is defined on an inner surface of the latch coupling.

6. The well system of claim 1, further comprising:

an interval control valve positioned uphole of the reentry window assembly and configured to regulate fluid production from a lateral wellbore; and a communications line communicably coupled to the interval control valve to actuate the interval control valve between open and closed configurations.

7. The well system of claim 6, further comprising one or more downhole sensors communicably coupled to the communications line, wherein the one or more downhole sensors provide real-time measurements of downhole conditions to the well surface location and the interval control valve is actuated based on the real-time measurements of downhole conditions.

8. The well system of claim 1, wherein the whipstock assembly further includes a running tool operatively coupled to the whipstock and the whipstock assembly moves the isolation sleeve between the first and second positions with the whipstock coupled to the sleeve coupling.

9. The well system of claim 1, wherein the casing exit is a first casing exit and the reentry window assembly is a first reentry window assembly, the well system further comprising:

a second casing exit;

a second reentry window assembly installed within the casing;

a first interval control valve positioned uphole of the first reentry window assembly and configured to regulate fluid production from a lateral wellbore;

a second interval control valve positioned uphole from the second reentry window and configured to regulate fluid production; and a communications line communicably coupled to the first and second interval control valves to actuate the first and second interval control valves between open and closed configurations.

10. The well system of claim 9, further comprising:

one or more first downhole sensors communicably coupled to the communications line; and one or more second downhole sensors coupled to the communications line, wherein the one or more first and second downhole sensors provide real-time measurements of downhole conditions and the first and second interval control valves are actuated based on the real-time measurements of downhole conditions.

11. The well system of claim 1, wherein the isolation sleeve in the first position seals the window and thereby isolates fluids in a parent wellbore from fluids in a lateral wellbore.

12. A method, comprising:

advancing a whipstock assembly into a parent wellbore lined with casing that defines a casing exit and has a lateral wellbore extending from the casing exit, the whipstock assembly including a whipstock and an aligning tool operatively coupled to the whipstock;

extending the whipstock assembly into a completion window assembly that provides a muleshoe and has a window aligned with the casing exit, wherein the completion window assembly further includes upper and lower slots provided on opposing axial ends of the window;

engaging the aligning tool on the muleshoe and thereby angularly orienting a whipstock face of the, whipstock to the window;

coupling the whipstock to a sleeve coupling provided on an isolation sleeve positioned within the completion window assembly, and the isolation sleeve further provides an alignment key; and deflecting a downhole tool off the whipstock face and through the window to access the lateral wellbore.

13. The method of claim 12, further comprising sealing the window with the isolation sleeve and thereby isolating fluids in the parent wellbore from fluids in the lateral wellbore.

14. The method of claim 12, wherein coupling the whipstock to the sleeve coupling further comprises moving the isolation sleeve from a first position, where an engagement device provided on the isolation sleeve engages the upper coupling of the completion window assembly and the isolation sleeve occludes the window, and to a second position, where the isolation sleeve engages a lower coupling and the window is exposed.

15. The method of claim 14, further comprising:

interacting the sleeve alignment key with the upper and lower slots and thereby maintaining the isolation sleeve in a predetermined angular orientation while moving between the first and second positions.

16. The method of claim 14, wherein upper and lower couplings are provided on an inner surface of the completion window assembly adjacent opposing axial ends of the window, the method further comprising:

securing the isolation sleeve in the first position by mating an engagement device of the isolation sleeve with the upper coupling; and securing the isolation sleeve in the second position by mating the engagement device with the lower coupling.

17. The method of claim 12, wherein advancing the whipstock assembly into the parent wellbore is preceded by moving the isolation sleeve from a first position, where an engagement device provided on the isolation sleeve engages an upper coupling of the completion window assembly and the isolation sleeve occludes the window, and to a second position, where the isolation sleeve engages a lower coupling and the window is exposed.

18. The method of claim 12, wherein engaging the aligning tool on the muleshoe comprises slidingly engaging an alignment key of the aligning tool on a muleshoe profile defined on the muleshoe and thereby angularly orienting the whipstock face to the window.

19. The method of claim 12, wherein the casing exit is a first casing exit, the lateral wellbore is a first lateral wellbore, and the completion window assembly is a first reentry window assembly, the method further comprising:

regulating fluid production from the first lateral wellbore with a first interval control valve positioned uphole of the parent wellbore from the first lateral wellbore;

regulating fluid production from a second lateral wellbore extending from a second casing exit defined in the parent wellbore with a second interval control valve positioned in the parent wellbore uphole from the second lateral wellbore, wherein a second reentry window assembly is installed within the parent wellbore at the second lateral wellbore; and actuating the first and second interval control valves between open and dosed configurations using control signals provided through a communications line extended from a well surface location and communicably coupled to the first and second interval control valves.

20. The method of claim 19, further comprising:

providing downhole condition measurements to the well surface location with one or more first downhole sensors arranged within the parent wellbore adjacent the first lateral wellbore and communicably coupled to the communications line;

providing downhole condition measurements to the well surface location with one or more second downhole sensors arranged within the parent wellbore adjacent the second lateral wellbore and communicably coupled to the communications line; and actuating the first and second interval control valves based on the downhole condition measurements.

21. The method of claim 19, wherein the isolation sleeve is a first isolation sleeve, the sleeve coupling is a first sleeve coupling, and the second reentry window assembly includes a second isolation sleeve having a second sleeve coupling, the method further comprising:

selectively locating and engaging an inner profile of one of the first and second sleeve couplings with one or more latch keys provided on the whipstock.

22. The method of claim 14, further comprising:

conveying a retrieving tool into the primary wellbore;

coupling the retrieving tool to the whipstock assembly; and moving the isolation sleeve back to the first position with the retrieving tool.

23. A reentry window assembly, comprising:

a completion window assembly having a window and providing an upper coupling, a muleshoe, and upper and lower slots provided on opposing axial ends of the window;

an isolation sleeve positioned within the completion window assembly and including a sleeve alignment key, a sleeve coupling, and an engagement device; and a whipstock assembly including a whipstock matable with the sleeve coupling and an aligning tool operatively coupled to the whipstock and engageable with the muleshoe to angularly orient a whipstock face to the window, wherein the isolation sleeve is movable between a first position, where the engagement device engages the upper coupling and the isolation sleeve occludes the window, and a second position, where the isolation sleeve engages a lower coupling and the window is exposed, and wherein the sleeve alignment key interacts with the upper and lower slots to maintain the isolation sleeve in a predetermined angular orientation while moving between the first and second positions.

* * * * *